US007992634B2

(12) United States Patent
Angelle et al.

(10) Patent No.: US 7,992,634 B2
(45) Date of Patent: Aug. 9, 2011

(54) ADJUSTABLE PIPE GUIDE FOR USE WITH AN ELEVATOR AND/OR A SPIDER

(75) Inventors: Jeremy R. Angelle, Lafayette, LA (US); Donald E. Mosing, Lafayette, LA (US); John E. Stelly, Breaux Bridge, LA (US)

(73) Assignee: Frank's Casing Crew and Rental Tools, Inc., Lafayette, LA (US)

( * ) Notice: Subject to any disclaimer, the term of this patent is extended or adjusted under 35 U.S.C. 154(b) by 0 days.

(21) Appl. No.: 12/126,072

(22) Filed: May 23, 2008

(65) Prior Publication Data

US 2009/0056930 A1 Mar. 5, 2009

Related U.S. Application Data

(63) Continuation-in-part of application No. 11/846,169, filed on Aug. 28, 2007.

(51) Int. Cl.
*E21B 19/24* (2006.01)

(52) U.S. Cl. ..... 166/85.5; 166/77.52; 294/102.2; 175/423

(58) Field of Classification Search ..... 166/75.14, 166/77.1, 77.14, 77.51, 77.52, 77.53, 85.1, 166/85.5; 294/102.2; 251/1.3; 175/423
See application file for complete search history.

(56) References Cited

U.S. PATENT DOCUMENTS 370,744 A * 9/1887 Mixer ..... 188/67
1,280,850 A 10/1918 Robichaux et al.
1,446,568 A * 2/1923 Krell ..... 294/113
1,548,543 A * 8/1925 Moody ..... 166/85.1
1,669,401 A * 5/1928 Davis ..... 294/90
2,048,209 A 7/1936 Young et al.
2,065,140 A * 12/1936 Lundeen ..... 188/67
2,263,364 A * 11/1941 Nichols ..... 294/102.2
2,578,056 A * 12/1951 French ..... 251/1.3
2,810,178 A 10/1957 Taylor
2,852,301 A * 9/1958 Gentry ..... 294/114

(Continued)

FOREIGN PATENT DOCUMENTS

DE 3537471 C1 10/1985

(Continued)

OTHER PUBLICATIONS

PCT International Search Report and Written Opinion, Feb. 17, 2009, pp. 1-13.

(Continued)

*Primary Examiner* — Kenneth Thompson
(74) *Attorney, Agent, or Firm* — Osha • Liang LLP

(57) ABSTRACT

One embodiment provides an adjustable guide 10*a* to steer the end 90 of a pipe string 88 into position to be engaged and supported by a pipe gripping apparatus such as, for example, an externally gripping elevator assembly 10. The adjustable guide 10*a* may comprise a plurality of angularly distributed guide inserts 30, each having a sloped surface 30A to engage a pipe end 90. Another embodiment provides an adjustable guide 60*a* to steer a pipe connection into position to pass through a spider 60. The guide inserts 30, 80 of an adjustable guide may be controllably positionable to together form a guide that is concentric with the bore of the tapered bowl of an elevator assembly or a spider. One embodiment comprises a guide insert retainer 11 having a plurality of channels 28, each slidably receiving a guide insert 30 and positionable by rotation of a threaded shaft 40.

100 Claims, 13 Drawing Sheets

U.S. PATENT DOCUMENTS

| | | | | | |
|---|---|---|---|---|---|
| 3,043,619 | A | | 7/1962 | George et al. | |
| 3,167,137 | A | | 1/1965 | Humphrey | |
| 3,424,257 | A | | 1/1969 | Kotlyarov et al. | |
| 3,454,297 | A | | 7/1969 | Turner | |
| 3,457,605 | A | * | 7/1969 | Kingsbury et al. | 188/67 |
| 3,472,535 | A | * | 10/1969 | Kinley | 285/123.11 |
| 3,495,864 | A | * | 2/1970 | Jones et al. | 294/90 |
| 3,748,702 | A | | 7/1973 | Brown | |
| 4,306,339 | A | * | 12/1981 | Ward | 188/67 |
| 4,449,596 | A | | 5/1984 | Boyadjieff | |
| 4,511,168 | A | * | 4/1985 | Haynes | 294/102.2 |
| 4,654,950 | A | | 4/1987 | Maidlow | |
| 4,715,456 | A | | 12/1987 | Poe, Jr. et al. | |
| 5,005,650 | A | | 4/1991 | Hopper | |
| 5,107,931 | A | * | 4/1992 | Valka et al. | 166/342 |
| 5,848,647 | A | | 12/1998 | Webre et al. | |
| 6,394,186 | B1 | | 5/2002 | Whitelaw et al. | |
| 6,394,201 | B1 | | 5/2002 | Feigel, Jr. et al. | |
| 6,651,737 | B2 | | 11/2003 | Bouligny et al. | |
| 6,814,149 | B2 | | 11/2004 | Liess et al. | |
| 6,994,176 | B2 | | 2/2006 | Shahin et al. | |
| 7,143,849 | B2 | | 12/2006 | Shahin et al. | |
| 7,383,885 | B2 | | 6/2008 | Bergeron et al. | |
| 7,395,855 | B2 | | 7/2008 | Ayling | |
| 7,546,884 | B2 | | 6/2009 | Veeningen et al. | |
| 2004/0016575 | A1 | | 1/2004 | Shahin | |
| 2004/0200622 | A1 | | 10/2004 | Jennings | |
| 2004/0251055 | A1 | | 12/2004 | Shahin et al. | |
| 2006/0225891 | A1 | | 10/2006 | Adams et al. | |
| 2008/0174131 | A1 | | 7/2008 | Bouligny et al. | |
| 2009/0252589 | A1 | | 10/2009 | Sonneveld et al. | |
| 2010/0059231 | A1 | | 3/2010 | Thomas et al. | |
| 2010/0101805 | A1 | | 4/2010 | Angelle et al. | |

FOREIGN PATENT DOCUMENTS

| | | | |
|---|---|---|---|
| EP | 1619349 | A2 | 1/2006 |
| WO | WO03031766 | A1 | 4/2003 |
| WO | 2007081952 | A1 | 7/2007 |

OTHER PUBLICATIONS

USPTO U.S. Appl. No. 11/846,169, "Non-Final Office Action, mailed May 26, 2009", 6 pages.

Angelle, Jeremy, U.S. Appl. No. 12/618,705, filed Nov. 13, 2009 "Method of Running a Pipe String Having an Outer Diameter Transition".

Frank's International, Inc. "PCT/US2007/074639 International Preliminary Report on Patentability", Mar. 2, 2010, 6 pages.

Frank's International, Inc. "Application No. EP10154443—European Search Report", The Hague (Patrick Dantinne), Apr. 21, 2010, 7 pages.

2M-Tek Tubular Systems "Flush-Tek(TM) Model S-503", Brochure, www.2m-tek.com, May 31, 2009, 2 pages.

Weatherford "Real Results—RMS 2400 Elevator and Flush-Mounted Spider Enhanced Safety in Deepwater Gulf of Mexico", Weatherford Dec. 3, 2008, 1 page.

Angelle, Jeremy, co-pending U.S. Appl. No. 11/846,169 "Segmented Bottom Guide for String Elevator Assembly", 20 pages.

Varco, excerpts from service manual, pp. 4 & 7.

Office Action in U.S. Appl. No. 12/126,072; dated Sep. 30, 2010 (5 pages).

Office Action in U.S. Appl. No. 12/618,705; dated Sep. 16, 2010 (7 pages).

Office Action in U.S. Appl. No. 12/126,072; dated Mar. 18, 2010 (6 pages).

Weatherford, "Tubular Running Services: UniSlips", Weatherford.com 2010 (2 pages).

EPO communication dated Jan. 31, 2011, issued by the European Patent Office in Application No. 08829182.8 (5 pages).

PCT International Search Report and Written Opinion, dated Jan. 26, 2011 in International Application No. PCT/US2010/033222 (9 pages).

Office Action in European Patent Application No. 10154443.5-1266; dated Apr. 8, 2011 (5 pages).

* cited by examiner

ADJUSTABLE PIPE GUIDE FOR USE WITH AN ELEVATOR AND/OR A SPIDER

STATEMENT OF RELATED APPLICATIONS

This application is a continuation-in-part application depending from and claiming benefit of priority to U.S. Ser. No. 11/846,169 filed on Aug. 28, 2007.

BACKGROUND

1. Field of the Invention

The present invention relates to an adjustable guide to position a portion of a pipe string within a pipe gripping assembly, such as an elevator assembly or a spider. The present invention relates to an adjustable guide to steer a pipe end into the bottom of an elevator assembly or to generally center a pipe connection so that it may pass through a spider on a drilling rig.

2. Background of the Related Art

Wells are drilled into the earth's crust and completed to establish a fluid conduit between the surface and a targeted geologic feature, such as a formation bearing oil or gas. Pipe strings used to drill or complete a well may be made-up as they are run into a drilled borehole. A casing string may be cemented into a targeted interval of a drilled borehole to prevent borehole collapse and/or formation fluid cross-flow, and to isolate the interior of the well from corrosive geologic fluids.

Generally, a pipe string may be suspended in a borehole from a rig using a pipe gripping assembly called a spider, and step-wise lengthened by threadably joining a pipe segment (which, for purposes of this disclosure, may be a pipe stand comprising a plurality of pipe segments) to the proximal end of the pipe string at the rig. The lengthened pipe string may then be suspended using a second type of gripping assembly called an elevator assembly that is movably supported from a draw works and a derrick above the spider. As the load of the pipe string is transferred from the spider to the draw works and the derrick, the spider may be unloaded and then disengaged from the pipe string by retraction of the spider slips. The lengthened pipe string may then be lowered further into the borehole using the draw works. The spider may again engage and support the pipe string within the borehole and an additional pipe segment may be joined to the new proximal end of the pipe string to further lengthen the pipe string.

Lengthening a pipe string generally involves adding one pipe segment at a time to an existing pipe string. Using one method, a pipe segment is secured to a lift line that hoists the pipe segment into the derrick to dangle the distal end of the pipe segment near the proximal end of the pipe string just above the spider. The distal end of the pipe segment may be, for example, an externally threaded male connection, or "pin end," of the pipe segment, and it may be positioned by rig personnel to be received into and bear against the proximal end of the pipe string that is suspended by the spider. The proximal end of the pipe string may be, for example, an internally threaded female connection, or a "box end" connection.

A stabber is a member of the rig crew that works in the derrick. The stabber may be secured to a structural component of the derrick to prevent him from falling as he leans out to manually position the proximal end of the pipe segment (which may be an internally threaded connection) to align the distal end of the pipe segment with the proximal end of the pipe string. A power tong may be used to grip and rotate the pipe segment about its axis to make-up the threaded connection between the distal end of the pipe segment and the proximal end of the pipe string to thereby lengthen the pipe string. The proximal end of the now-connected pipe segment then becomes the new proximal end of the lengthened pipe string.

After threadably connecting the pipe segment to the pipe string, the stabber may then align the new proximal end of the pipe string with the inlet of a bell guide that is coupled to the bottom of an elevator assembly. The stabber attempts to position the proximal end of the pipe string to enter the inlet of the bell guide as the elevator assembly is controllably lowered toward the spider using the draw works. After the proximal end of the pipe string passes through the bell guide and then exits the bell guide at its outlet, the proximal end of the pipe string may then enter a bore between the outlet of the bell guide and the gripping zone of the elevator assembly. Further lowering of the elevator assembly will then cause the proximal end of the pipe string to enter and pass through the gripping zone defined by the slips within the elevator assembly.

After the proximal end of the pipe string is received through the gripping zone of the elevator assembly, the elevator assembly slips may be actuated to engage and grip the pipe string just below its proximal end. Subsequently raising the elevator assembly using the draw works lifts the pipe string and unloads the spider. The draw works may then be used to controllably lower the elevator assembly toward the spider to position the proximal end of the pipe string just above the gripping zone of the spider. The spider may reengage and support the pipe string to strategically position the proximal end of the pipe string to receive and threadably connect to a new pipe segment. This step-wise method of lengthening a pipe string is repeated until the pipe string reaches its desired length.

Most gripping assemblies include a tapered bowl having a stepped profile. A stepped profile tapered bowl may comprise a stepped or variable profile within the tapered bowl to provide a generally staged convergence of the slips on the exterior surface of the pipe string. The initial stage of convergence may be a rapid radial convergence of the slips on the exterior surface of a pipe string, generally followed by a more gradual convergence as the slips engage, tighten and grip the exterior surface of the pipe string. While the stepped-profile design affords a more vertically compact elevator assembly, it also substantially limits the range of pipe diameters that may be gripped by the gripping assembly. Pipe strings are generally uniform in diameter and wall thickness throughout their length because gripping assemblies are generally adapted to grip only one size of pipe. Some geological formations, such as salt zones or unconsolidated formations, are prone to movement relative to adjacent formations, and this relative movement may necessitate the use of stronger, thicker-walled pipe at critical intervals to prevent unwanted pipe string failures. Other formations may present a more corrosive environment, thereby necessitating a thicker-walled pipe string. One method of protecting the well against damage in these critical formations is to form the entire pipe string using the thicker and more expensive pipe, but this approach results in a substantial increase in cost.

An alternative method is to install a tapered pipe string, which is a pipe string that has one or more outer pipe diameter transitions along its length. For example, a tapered pipe string may have a first portion with a first pipe wall thickness and outside diameter, and a second portion with a second pipe wall thickness and outside diameter. The second portion of the tapered pipe string may be connected to extend the length of the tapered pipe string beyond the length of the first portion. A tapered pipe string may be installed in a well so that a thicker and stronger-walled portion of the tapered pipe string is strategically positioned within a more critical depth interval of the well. For example, but not by way of limitation, a thicker-walled first portion may be disposed within a tapered pipe string nearer to the surface so that the lower, thinner-walled second portion of the tapered pipe string will be adequately supported by the stronger first portion. As another example, but not by way of limitation, a thicker-walled second portion may be positioned adjacent to an unconsolidated formation or an unstable formation penetrated by the well to ensure that the tapered pipe string offers more resistance to movement or shear as a result of movement in the unconsolidated or unstable formation.

Using conventional, stepped profile tapered bowls, forming a tapered pipe string normally requires the use of two or more elevator assemblies and two or more spiders so that two or more diameters of pipe can be made-up and run in a single pipe string. This approach requires rig downtime to change out the elevator assembly or the spider, or both, for each outer diameter transition.

A different type of tapered bowl for a gripping assembly may comprise a tapered bowl having a smooth and non-stepped profile. FIGS. 1A and 1B illustrate the cross-section of a tapered bowl 120 of a elevator assembly or a spider 110 having a non-stepped profile. For illustration purposes, FIG. 1A shows a spider adapted for being supported from a rig floor, but it should be understood that the same mechanical cooperation and relationship between a tapered bowl and a set of slips may exist in a conventional string elevator, a casing running tool (CRT), or other pipe gripping apparatus having a non-stepped profile.

FIG. 1A shows a set of slips 122 positioned within the tapered bowl 120 to grip a pipe string 188 having a first diameter D1. The slips 122 may be positioned using a timing ring 118 that may be vertically movable, e.g., using extendable rods 119.

FIG. 1B shows the same set of slips 122 positioned vertically higher within the same tapered bowl 120 to grip a second, larger diameter portion of the same pipe string 188 having a diameter D2. These figures illustrate how a smooth, non-stepped profile tapered bowl may be used to run a first portion of a tapered pipe string having a first diameter and to run a second portion of the tapered pipe string having a second diameter without rig downtime to replace the elevator assembly or the spider.

A tapered bowl having a non-stepped profile enables the gripping assembly to engage and grip a range of pipe diameters. The "gripping zone," as that term is used herein, may be defined as the space within the tapered bowl and between the angularly distributed arrangement of slips, and it varies in size and shape according to the vertical elevation of the set of slips within the tapered bowl when they are engage and grip the pipe.

A limitation that may affect the utility of a spider, elevator assembly (e.g., string elevator, CRT) or other pipe gripping assembly (for example, one having a non-stepped profile) is the difficulty of positioning the proximal end of the pipe string within the gripping zone of the gripping assembly. Wear, warping and material imperfections in the pipe segments or connections may cause the pipe string to be non-linear. Imperfections in the derrick and/or the rig floor, and other factors such as wind and thermal expansion may all combine to cause the bore of the elevator assembly to be misaligned with the proximal end of the pipe string, or to cause the bore of the spider to be misaligned with a pipe connection within the pipe string. For these reasons, the rig crew often has to manually position the proximal end of a pipe string to enter the elevator assembly or to position a pipe connection towards the center of the bore of the spider. It is important that the slips of the tubular gripping apparatus, for example a spider, CRT or elevator assembly, engage and set against the exterior surface of the pipe string as simultaneously and evenly as possible to prevent damage to equipment or to the pipe string, and to ensure a positive grip.

Devices have been developed to assist the rig crew in aligning the proximal end of the pipe string with the elevator assembly. For example, a conventional bell guide is a rigid and generally inverted, funnel-shaped housing that may be coupled to the bottom of an elevator assembly and used to engage and steer the proximal end of the pipe string into the bore of the tapered bowl beneath the gripping zone of the elevator assembly. As the elevator assembly is lowered over the pipe string, the proximal end of a pipe string may engage the sloped interior surface of the bell guide. The reaction force imparted to the proximal end of the pipe string by the bell guide has a compressive component and a radial component. As the elevator assembly is lowered, the proximal end of the pipe string may slide along the interior surface of the bell guide until it reaches the outlet of the bell guide, enter the bore of the tapered bowl of the elevator assembly, and then pass through the gripping zone of the elevator assembly defined by the retracted slips.

A conventional bell guide may have a significant limitation when used with a elevator assembly with a smooth, non-stepped tapered bowl adapted for gripping a broad range of pipe diameters. The size of the outlet of the bell guide must necessarily be larger than the largest diameter of pipe that can be gripped by the elevator assembly. If the outlet of the bell guide is too small to pass the largest pipe diameter that may be gripped by the elevator assembly, then the bell guide may need to be replaced in order to make-up and run a large diameter pipe string. Depending on its capacity, an elevator assembly may weigh up to 15,000 pounds or more, and the bell guide alone may weigh hundreds of pounds. Replacing the bell guide may be difficult and time consuming. Similarly, a bell guide sized to accommodate a large-diameter pipe string may not be useful for running a smaller diameter pipe string. If the outlet at the proximal end of the bell guide is too large, then a smaller diameter pipe string may not be sufficiently aligned by the bell guide with the bore of the gripping zone in the tapered bowl of the elevator assembly as it exits the bell guide, and the proximal end of the pipe string may enter the elevator assembly and hit the bottom of one or more slips as the elevator assembly is lowered over the proximal end of the pipe string.

A bottom guide is another tool that may cooperate with a bell guide and a elevator assembly to position the end of the pipe string to enter the elevator assembly. The bottom guide may be coupled between the outlet of a bell guide and the bore in the bottom of the tapered bowl to receive the end of the pipe string as it passes the bell guide and to further direct it to the bore of the tapered bowl. In one embodiment disclosed in the parent application from which this application depends, a bottom guide may comprise a plurality of replaceable inserts to cooperate with a bell guide and to provide a second convergent structure to position the proximal end of a pipe string within the gripping zone of the elevator assembly. A bottom guide has the same limitation as a bell guide when used with elevator assemblies with tapered bowls having a non-stepped profile. That is, the bottom guide may require adjustment or retrofitting when the pipe diameter being run into the borehole is changed.

A spider, like an elevator assembly, may also include a tapered bowl having a smooth, non-stepped profile that enables the spider to grip and support a broader range of pipe diameters. Unlike a elevator assembly, a spider does not typically receive the end of a pipe string (except on the very first pipe segment used to begin the string), but it may receive and pass internally threaded pipe sleeves of the kind used to form conventional threaded pipe connections. Each internally threaded sleeve comprises a downwardly disposed shoulder that may be, depending on the diameter and grade of the pipe string being formed, up to 0.30 inches or more in thickness. Misalignment of a pipe connection as it passes through the tapered bowl of the spider may result from the same material imperfections, winds and thermal expansion or contraction, that affect alignment between the bore of the gripping zone of a elevator assembly and the proximal end of the pipe string. A misaligned pipe connection may cause the sleeve to hang on the top of one or more slips or other structures of the spider as the lengthened pipe string is lowered into the borehole using the draw works. Given the large weight of a pipe string, hanging a sleeve shoulder on a spider slip as the pipe string is lowered through the spider may damage the spider, the pipe connection, or both.

A gripping assembly capable of gripping and supporting a broad range of pipe string diameters without alignment problems would provide a significant advantage because it could be used to make-up and run tapered pipe strings, or pipe strings having a generally telescoping configuration, into a borehole with less rig downtime. But misalignment problems caused by material imperfections in pipe, the derrick and other rig structures, and winds and thermal expansion or contraction, make it difficult to achieve the full benefit of using gripping assemblies with tapered bowls having non-stepped profiles. While some tools exist to center the proximal end of a pipe string or a pipe connection, these conventional tools limit the range of diameters of pipe that may be run, thereby defeating the advantage provided by the use of a gripping assembly having a tapered bowl with a non-stepped profile.

What is needed is an adjustable guide that can be coupled to an elevator assembly to position the proximal end of a pipe string relative to the bore of the elevator assembly, and that can be used to position pipe strings within a range of pipe string diameters. What is needed is an adjustable guide that can be coupled to a spider to position a pipe connection relative to the bore of the spider, and that can be used to position pipe connections within a range of pipe connection diameters. What is needed is an adjustable guide that may be used to radially position the proximal end of a pipe string as the elevator assembly is lowered over the proximal end of the pipe string, and that can be used to position pipe strings having a range of diameters. What is needed is an adjustable guide that may be used to radially position a pipe connection within a pipe string as the pipe string is lowered through the spider, and that can be used to position pipe connections having a range of diameters.

SUMMARY

This invention satisfies some or all of the above needs, and others. One embodiment provides a method of forming a tapered pipe string having at least one outer diameter transition along its length without replacing the gripping assemblies. One embodiment includes the steps of using a spider and a elevator assembly, each having smooth, non-stepped tapered bowls for receiving and cooperating with a set of slips, to make-up and run a first portion of a pipe string having a first diameter, connecting a pipe segment having a second diameter larger than the first to the proximal end of the first portion of the pipe string, and using the same spider and elevator assembly to make-up additional pipe segments having the second diameter to lengthen the pipe string. The resulting tapered pipe string may be used to strategically position thicker-walled pipe at critical intervals of the borehole, while using less expensive standard pipe at less critical intervals of the borehole to minimize the overall cost of the completed well.

The forming of a tapered pipe string using the method described above may be hindered if the proximal ends of smaller diameter segments of the tapered pipe string do not sufficiently align with the bore of the elevator assembly, or if threaded connections of the smaller diameter portion of the tapered pipe string do not sufficiently align with the bore of the spider. In these events, the proximal end of the pipe string or the internally threaded sleeve of the threaded pipe connections may hang on or otherwise land on slips or other portions of the elevator assembly or spider due to misalignment. This problem may be abated using another embodiment of the method that comprises the steps of securing an adjustable pipe guide to the bottom of the elevator assembly, and adjusting the adjustable pipe guide to steer the proximal end of a pipe string into the bore of the elevator assembly as the elevator assembly is being lowered over the proximal end of the pipe string. The adjustable guide may be securable to the bottom of the elevator assembly, or the portion disposed toward the spider, in a generally aligned position with a bore of its tapered bowl. The additional steps pertaining to the installation and use of the adjustable guide facilitates the unobstructed entry of the proximal end of the pipe string into the bore in the bottom of the tapered bowl as the elevator assembly is lowered over the proximal end of the pipe string.

An adjustable pipe guide apparatus that may be used in the steps of the alternate embodiment of the method may comprise a set of generally angularly distributed guide inserts, each guide insert being radially positionable within or on a guide insert retainer. The guide inserts each may have a retracted position and at least one deployed position to engage and position the proximal end of a pipe string into general alignment with the bore of the tapered bowl of the elevator assembly.

Another embodiment of the method comprises the steps of securing an adjustable pipe guide to the top portion of a spider to center a pipe connection within a pipe string to generally coincide with the bore of the spider. The steps may include securing the adjustable pipe guide to the top portion of the spider, or the portion of the spider disposed toward the elevator assembly, and deploying the adjustable guide to generally center a pipe connection of a pipe string within the bore of the spider to facilitate unhindered movement of the pipe connection through the disengaged spider as the pipe string is lowered into a borehole. The adjustable pipe guide apparatus that may be used in the steps of this embodiment of the method may comprise a plurality of generally angularly distributed guide inserts, each guide insert radially positionable within or on a guide insert retainer. The guide inserts each may have a retracted position and at least one deployed position to engage and generally center a pipe connection of a pipe string into general alignment with the bore of the tapered bowl of the spider.

Another embodiment of the apparatus comprises an adjustable guide wherein the guide inserts are each movable within a groove, a furrow, passage, gutter or channel in a guide insert retainer. The guide inserts may be rollably, slidably or pivotably movable relative to the guide insert retainer. The guide inserts may each be coupled to and radially positionable relative to the guide insert retainer by a drive member to provide controlled radial positioning of the guide inserts between a retracted position and the at least one deployed position. The drive member may comprise a threaded shaft, a pneumatic cylinder, a hydraulic cylinder, a rack and pinion gear, or some other mechanical drive device to provide controlled deployment and/or retraction of each guide insert. The drive member may be pneumatically, hydraulically, or electrically powered, and the drive member may be remotely controlled using wired or wireless control.

For example, but not by way of limitation, a drive member used to controllably and radially position a guide insert may comprise an externally threaded and rotatable shaft that is threadably received within an internally threaded hole in the guide insert. In this embodiment, the threaded shaft is controllably rotatable about its axis to so that rotation of the threaded shaft in a first direction deploys the guide insert radially towards its at least one deployed position, and rotation of the threaded shaft in the second, opposite direction retracts the guide insert radially towards a retracted position. It should be understood that the controlled rotation of the threaded shaft may be manual, such as by use of a crank, a hand tool with a bit or a hand-held drill, or the controlled rotation may be powered using a motor. In one embodiment, an adjustable guide may comprise guide inserts that are radially positionable using a small servo-motor coupled to the threaded shaft for imparting controlled rotation to the shaft to deploy and retract the guide insert. The servo-motor used to position a guide insert may be pneumatically, hydraulically or electrically powered, and a single motor may be mechanically coupled to one, two or more adjacent threaded shafts to achieve simultaneous guide insert deployment or retraction.

An adjustable guide having one or more powered servo-motors to deploy and retract guide inserts may be remotely controlled using wired or wireless systems. A portable power source, such as a battery, may be disposed onboard the adjustable guide to power the servo-motor(s) and other control circuitry or devices related to the adjustable guide. Remotely controlling the adjustable guide may provide enhanced flexibility and enable the user to engage and "push" the proximal end of a pipe string or a pipe connection toward a desired position instead of relying only on the radial component of the force imparted by contact between the pipe string and one or more guide inserts to position the pipe string. For example, but not by way of limitation, an adjustable guide coupled to the bottom of an elevator assembly may be "opened" by fully retracting the guide inserts to capture the proximal end of a pipe string that is misaligned with the centerline of the elevator assembly and, once the proximal end of the pipe string is disposed within the radially interior space formed between the guide inserts, the adjustable guide may be remotely actuated to deploy the guide inserts and thereby reduce the size of the radially interior space. In this manner, the adjustable guide may be used to push the proximal end of the pipe string toward the center bore of the elevator assembly. It should be noted that with an adjustable guide on an elevator assembly, as opposed to a spider, there may be lateral displacement of the pipe string combined with lateral displacement of the elevator assembly in the opposite direction to reduce misalignment between the proximal end of the pipe string and the bore of the tapered bowl of the pipe string.

In one embodiment, the guide inserts may each comprise at least one generally sloped surface to engage and impart a positioning force to a pipe end or to the sleeve of a pipe connection. The sloped surface of a guide insert may be sloped at, for example, a 45 degree angle relative to vertical to impart a force to the pipe string that has a generally lateral component to position a pipe end or a pipe connection. The sloped surfaces of the guide inserts may together form portions of a variable and generally frustoconical guide to steer a pipe end or a pipe connection generally towards alignment with the bore of the tapered bowl of an elevator assembly or a spider.

In an embodiment, a guide insert retainer may comprise two or more guide insert retainer portions that cooperate to position the guide inserts in a generally angularly distributed arrangement that is generally aligned with the bore of the tapered bowl of the elevator assembly or the spider. Each guide insert retainer portion may comprise one or more grooves, tracks or channels therein to slidably receive a corresponding tongue, rail or key on the at least one guide insert. The guide insert retainer portion may be movably secured to the elevator assembly or spider, and movable between a deployed position, to position the guide inserts in a generally angularly distributed arrangement aligned with the bore of the tapered bowl, and a removed position, to remove the guide inserts away from the bore and out of an angularly distributed arrangement. In another embodiment, two or more guide insert retainer portions may be actuatable to move between the removed position and the deployed position by a retainer drive member, such as a cylinder. In yet another embodiment, two or more guide insert retainer portions may be hingedly movable between the deployed position and the removed position.

In another embodiment, the guide insert retainer may comprise a bell guide. That is, the guide insert retainer may comprise a generally frustoconical and rigid interior guide surface that can be used when the guide inserts are in the retracted position to engage and position the proximal end of a pipe string or a pipe connection generally into alignment with the bore of the tapered bowl of an elevator assembly or a spider, respectively. Each guide insert may be movable within a channel terminating at an aperture in the bell guide between a generally retracted position and at least one deployed position. The guide inserts may each comprise a generally sloped surface that may be positioned to be generally flush with the interior surface of the bell guide when the guide inserts are in the retracted position, and the guide inserts may each be deployable from that retracted position to radially position the sloped surfaces within the interior of the bell guide to provide an adjustable guide.

The embodiments of the adjustable guide disclosed herein may be especially useful to form and install a tapered pipe string in a borehole without damaging the elevator assembly or the spider due to misalignment and without additional rig downtime to change out the elevator assembly or the spider.

So that the manner in which the above recited features of the present invention can be understood in detail, a more particular description of the invention, briefly summarized above, may be had by reference to embodiments, some of which are illustrated in the appended drawings. However, that the appended drawings illustrate only typical embodiments of this invention and are therefore not to be considered limiting of its scope, for the invention may admit to other equally effective embodiments.

DETAILED DESCRIPTION OF THE PREFERRED EMBODIMENT

Embodiments of the adjustable guide is useful to position the proximal end of a pipe string, or a pipe connection within a pipe string, relative to an elevator assembly, or relative to a spider, respectively that may have a smooth, non-stepped tapered bowl. The adjustable guide may be used to make-up and run a pipe string into a drilled borehole, particularly a tapered pipe string having at least one outer diameter transition along its length.

Figure 2:
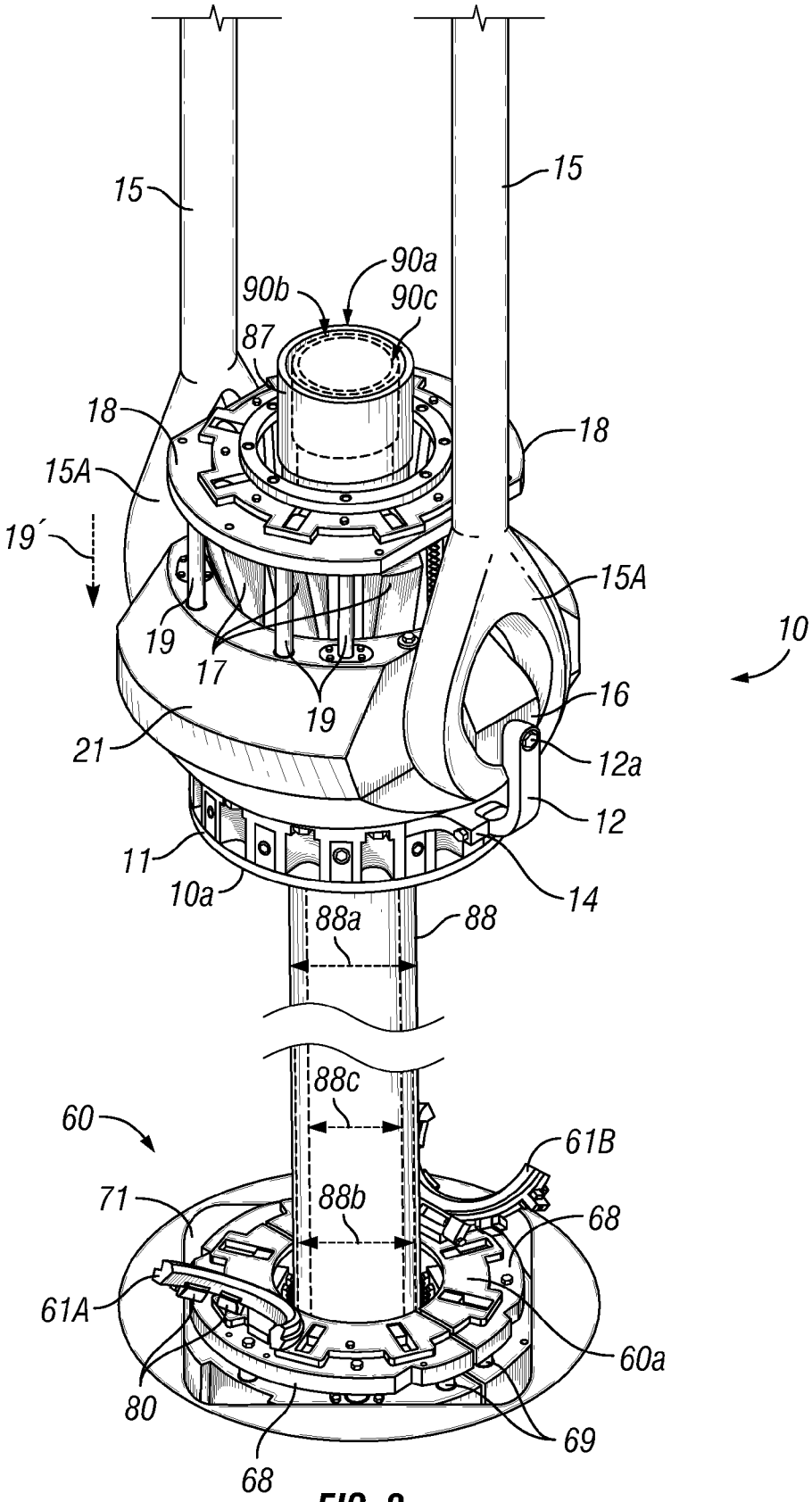
FIG. 2 is a top perspective view of an elevator assembly supporting one embodiment of an adjustable guide and a cooperating spider there below and supporting another embodiment of an adjustable guide.

FIG. 2 is a perspective view of an elevator assembly 10 supporting an embodiment of the adjustable guide 10*a*, and also of a cooperating spider assembly 60, that is generally aligned with and cooperates with the elevator assembly 10. FIG. 2 illustrates an embodiment of an elevator assembly 10 having a tapered bowl 21, and a plurality of slips 17 coupled to a timing ring 18 and movable radially inwardly and downwardly within the tapered bowl 21 to grip and support a pipe string 88 having a diameter of 88*a* that is received through the bores of both the elevator assembly 10 and the spider assembly 60. The proximal end 87 of the pipe string 88 is shown in FIG. 2 to be positioned immediately above or generally even with the timing ring 18. FIG. 2 illustrates a favorable position of the internally threaded sleeve 90*a* (coupled to the proximal end 87 of the pipe string 88) relative to the timing ring 18 and the retracted slips 17. From the position illustrated in FIG. 2, actuation of the timing ring 18 will set the slips 17 to wedge between the interior of the tapered bowl 21 and the exterior surface of the pipe string 88 immediately below the sleeve 90*a*. The position of the pipe string 88 shown in FIG. 2 may be achieved using the adjustable guide 10*a* to position a pipe string 88 to enter the elevator assembly 10.

The elevator assembly 10 shown in FIG. 2 is supported above a rig floor using a pair of elongate bails 15, each comprising a lift eye 15*a* at its distal end to receive one of a pair of opposed lift ears 16 that protrude radially outwardly from the tapered bowl 21. The opposite end of the bails (not shown in FIG. 2) may be pivotally secured to a block that is, in turn, movably supported by a draw works. Operation of the draw works positions the elevator assembly 10 at the desired elevation relative to the spider assembly 60.

The slips 17 of the elevator assembly 10 are movable between an engaged position and a disengaged position (shown in FIG. 2) using the timing ring 18. The timing ring 18 may be actuated downwardly in the direction of arrow 19' by retraction of rods 19 into elongate cylinders within the tapered bowl 21 to wedge the slips 17 between the interior of the tapered bowl (not shown in FIG. 2) and the exterior surface of pipe string 88. The elevator assembly 10 may be disengaged from the exterior surface of pipe string 88 by extending rods 19 upwardly and out of the cylinders in the tapered bowl 21, opposite the direction of arrow 19', to distance the timing ring 18 from the tapered bowl 21 and to retract the slips 17 upwardly and radially outwardly away from the exterior surface of the pipe string 88. The rods 19 may be hydraulically, pneumatically or mechanically extendable from the tapered bowl 21 to disengage the slips 17 from the pipe string 88, and the rods 19 may be hydraulically, pneumatically, mechanically or gravitationally retractable to lower and thereby re-engage the slips 17 with the pipe string 88.

Referring again to FIG. 2, the elevator assembly 10 comprises an adjustable guide 10*a* coupled to the bottom of the tapered bowl 21, or to an intermediate member, such as an adapter plate. FIG. 2 also shows a spider assembly 60 having a tapered bowl 71 that is generally aligned with the tapered bowl 21 of the elevator assembly 10. The spider assembly 60 shown in FIG. 2 movably supports a timing ring 68 that may be raised and distanced from the tapered bowl 71 by extension of rods 69 to disengage the slips 67 (not visible in FIG. 2) from the exterior surface of pipe string 88, and again lowered to wedge the slips 17 between the interior wall (not shown in FIG. 2) of the tapered bowl 71 and the exterior surface of pipe string 88 by retraction of the rods 69 back into the tapered bowl 71. The spider assembly 60 shown in FIG. 2 comprises another embodiment of the adjustable guide 60*a* to position pipe connections (not shown in FIG. 2) that pass through the tapered bowl 71 of the spider assembly 60. The embodiment of the adjustable guide 60*a* of the spider assembly 60 comprises a plurality of guide inserts 80 that are movably retained on or within guide insert retainer portions 61*a* and 61*b*, each of which is hinged to pivot between the retracted position shown in FIG. 2 and the deployed position shown in FIGS. 8A, 8B and 8C.

FIG. 2 also illustrates a range of pipe diameters that may be handled using the spider assembly 60 and the elevator assembly 10 of FIG. 2. Some embodiments of the adjustable guide may be used to make-up and run tapered pipe strings that have one or more outer pipe diameter transitions. For example, but not by way of limitation, the adjustable guide may be used to make-up and run a pipe string having at least a first portion with a first diameter, and a second portion with a second diameter that is connected to extend the pipe string beyond the length of the first portion. As a further example, FIG. 2 illustrates a pipe string 88 of a diameter 88*a* that corresponds to a pipe connection 87 with a pipe end 90*a*. FIG. 2 includes concentric dotted circles within the bore of the proximal pipe end 90*a* of pipe string 88 illustrating the size of a small pipe end 90*c* corresponding to smaller pipe diameter 88*c*, and an intermediate pipe end 90*b* corresponding to an intermediate pipe diameter 88*b*. The following description, along with the appended drawings, discusses the use of the adjustable guide 10*a* to form a tapered pipe string that may include portions having diameters 88*a*, 88*b* and 88*c* and corresponding sleeve connections 90*a*, 90*b* and 90*c*.

Figure 3:
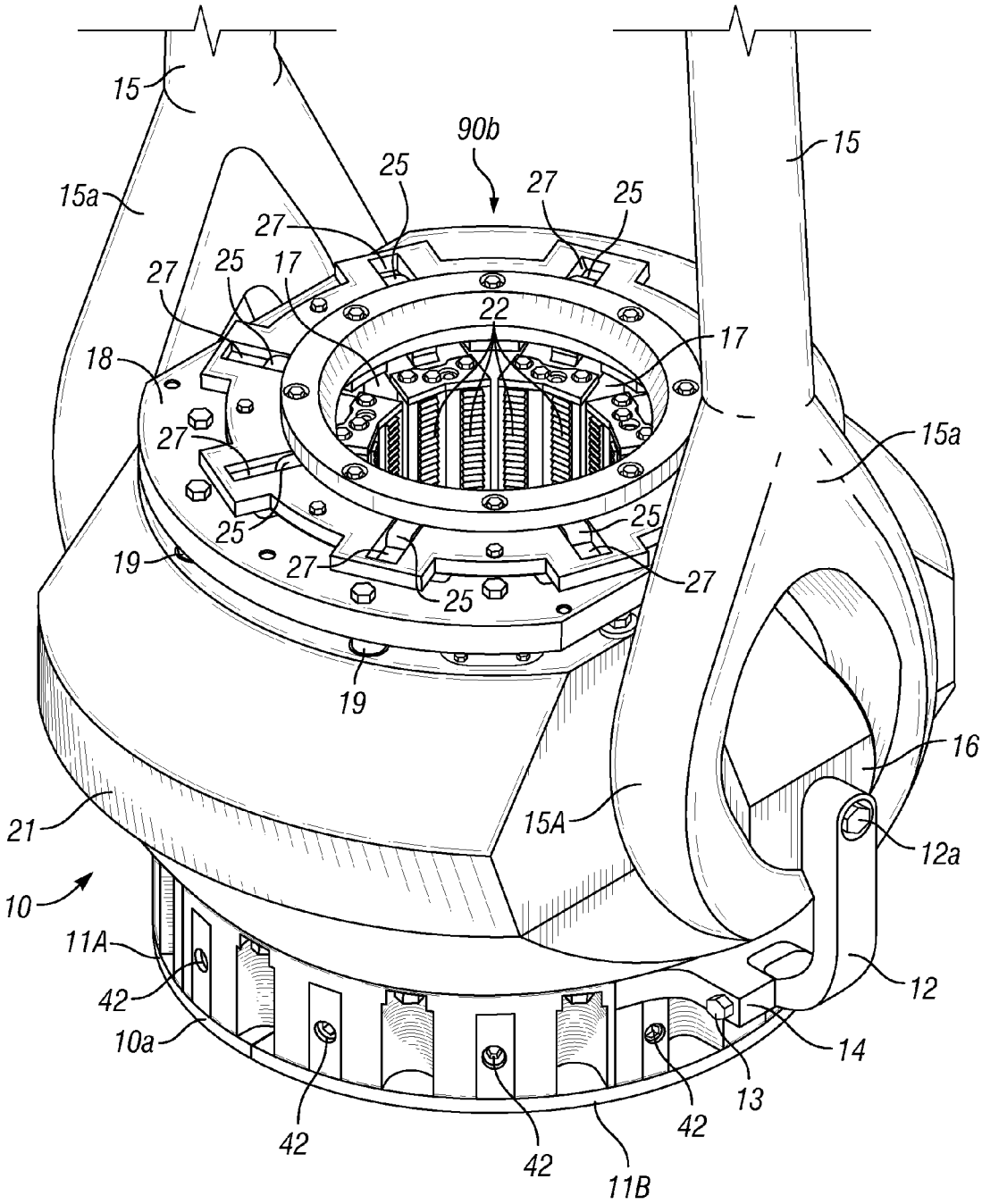
FIG. 3 is an enlarged top perspective view of the adjustable guide supported by the elevator assembly in FIG. 2 after the timing ring is lowered to move the slips to an engaged position. The pipe string shown in FIG. 2 is omitted to show additional features of the elevator assembly.

FIG. 3 is an enlarged perspective view of the embodiment of the adjustable guide 10*a* of the elevator assembly 10 illustrated in FIG. 2 after the timing ring 18 is lowered by retraction of rods 19 in the direction of arrow 19' (shown on FIG. 2) to move the slips 17 to their engaged position against the pipe string 88. In FIG. 3, the pipe string 88 shown in FIG. 2 is omitted to show additional features of the elevator assembly 10. It should be understood that the engaged configuration of the elevator assembly 10 shown in FIG. 3 is generally used to grip and support a pipe string 88 similar to the one shown in FIG. 2. The adjustable guide 10*a* shown in FIG. 3 comprises a plurality of rotatable sockets 42 that are each coupled to the end of a threaded shaft used to position a guide insert (not shown in FIG. 3). The guide inserts of the adjustable guide 10*a* of FIG. 3 will be discussed in more detail in relation to FIGS. 4A-6C. The adjustable guide 10*a* shown in FIG. 3 further comprises guide insert retainer portions 11*a* and 11*b*, each generally semi-circular in shape and each pivotably coupled at pin 13 to a hanger 12 that pivotally secures the guide insert retainer portions 11*a* and 11*b* to the elevator assembly 10. Each of the hangers 12 may be releasably coupled to a protruding ear 16 of the tapered bowl 21 using a bolt 12*a*. Additional or alternate fastners, such as bolts, screws, clamps or other devices may be used to secure the guide insert retainer to the elevator assembly.

The omission of the pipe string 88 (see FIG. 2) from FIG. 3 reveals a plurality of gripping dies 22 fastened to the faces of the slips 17. The gripping dies 22 may be removable to provide a replaceable gripping face with a surface that promotes a positive grip on the pipe string (not shown in FIG. 3) without slipping. The gripping dies 22 may be non-marking in order to prevent unnecessary deformation on the exterior surface of the pipe string (not shown in FIG. 3—see element 88 in FIG. 2). FIG. 3 also illustrates a fin 25 on each slip 17 that is movably received within an aperture 27 in the timing ring 18 to provide a visual indication of the position of the slip 17. The fin 25 moves radially inwardly within the aperture 27 when the slip 17 is moved downwardly (in the direction of arrow 19' of FIG. 2) and radially inwardly to engage and grip the exterior surface of the pipe string 88 (not shown—see FIG. 2). The fin 25 moves radially outwardly within the aperture 27 when the slip 17 is moved upwardly (opposite the direction of arrow 19' of FIG. 2) and radially outwardly from the exterior surface of the pipe string 88. The fin 25 and the aperture 27 within which it moves may be shaped to cooperate and to maintain the orientation of the slip 17 within the tapered bowl 21 to prevent the slip 17 from being inadvertently misaligned by a pipe connection or a pipe end.

It should be understood by those skilled in the art that the guide inserts of the adjustable guide may comprise a steering surface, which is a portion of the guide insert that may be positioned to actively engage and displace a pipe end and/or a pipe connection. It should be understood that the sloped steering surface of each guide insert is generally disposed on the guide insert in an orientation that facilitates engagement with a pipe end and/or a pipe connection that may be received in and/or through the adjustable guide.

Figure 4A:
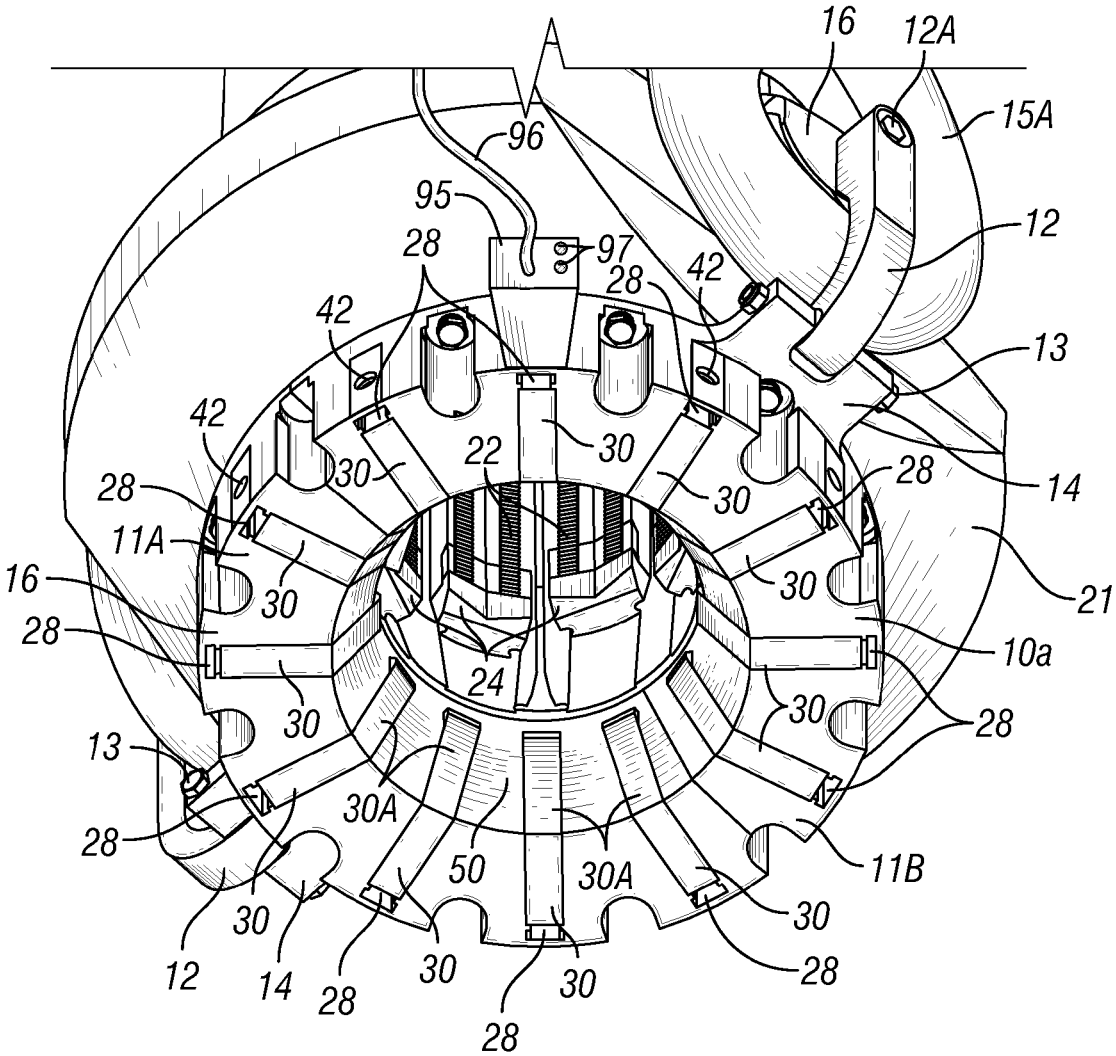
FIG. 4A is a bottom perspective view of the adjustable guide supported on the elevator assembly of FIG. 3 revealing a plurality of angularly distributed guide inserts, each retracted within a channel in a guide insert retainer.
Figure 4B:
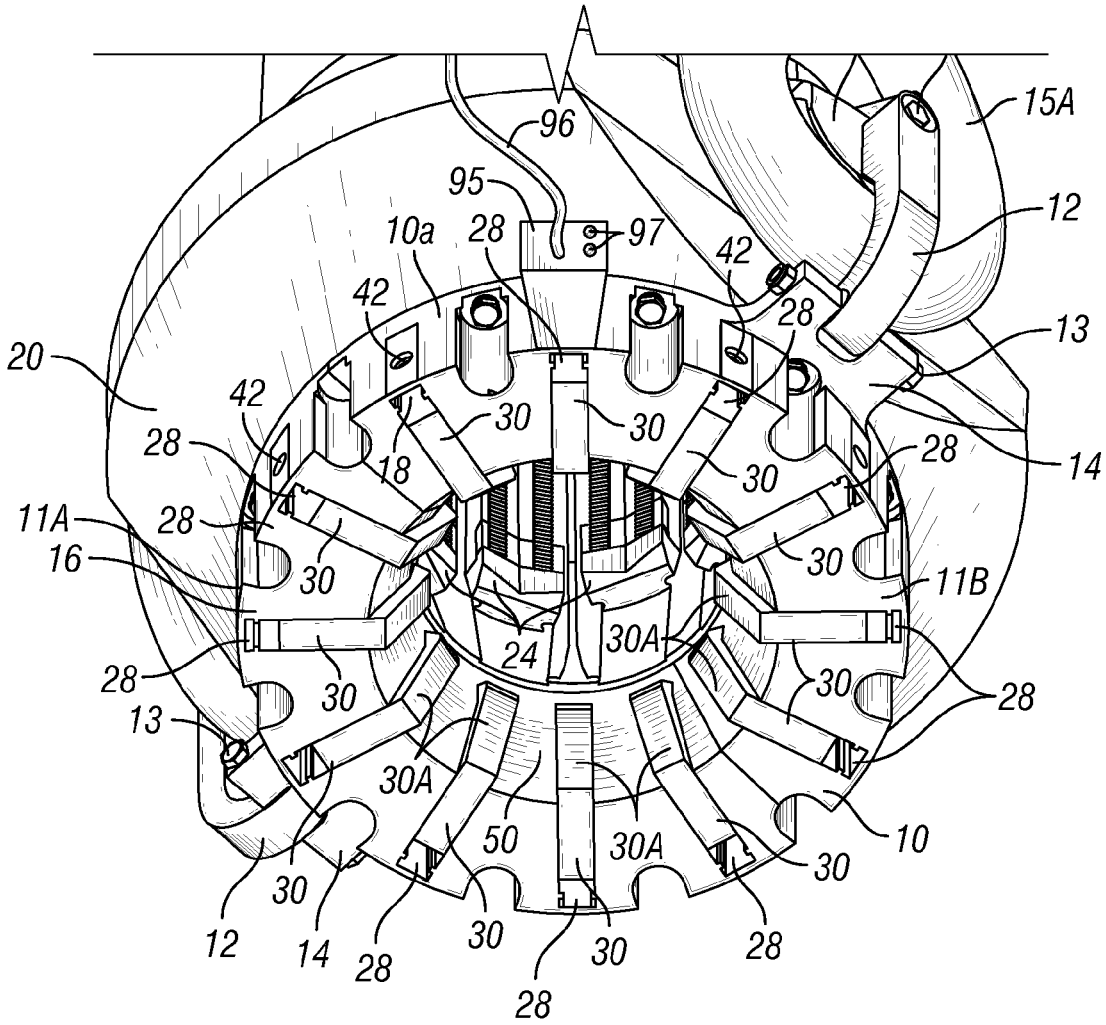
FIG. 4B is the perspective view of the adjustable guide of FIG. 4A after deployment of the guide inserts to a first deployed position.
Figure 4C:
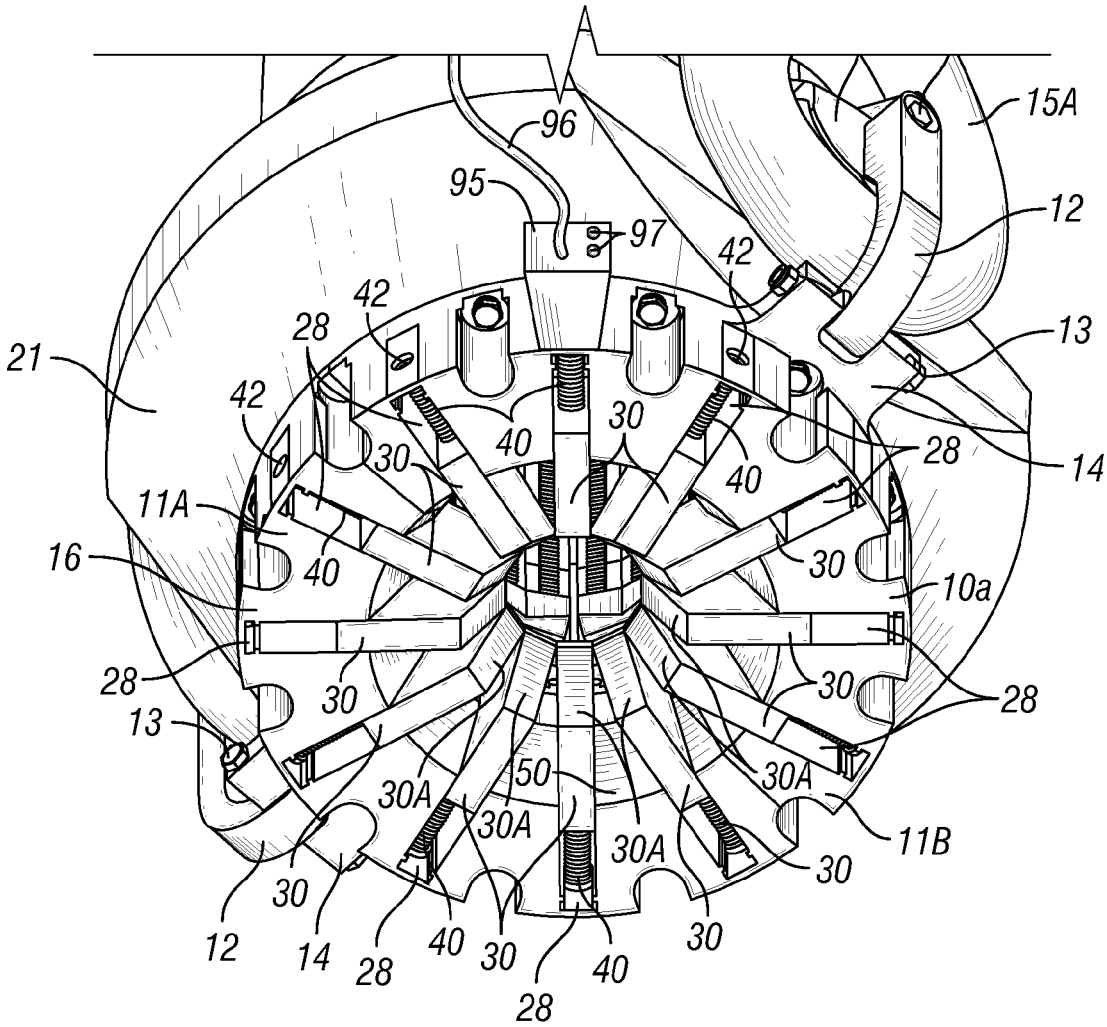
FIG. 4C is the perspective view of the adjustable guide of FIG. 4B after further deployment of the guide inserts to a second deployed position.

FIGS. 4A-4C is a series of perspective views of one embodiment of the adjustable guide 10*a* illustrating three achievable configurations. Again, the pipe string (see element 88 in FIG. 2) is omitted from FIGS. 4A-4C to reveal details of the elevator assembly 10. FIG. 4A is a bottom perspective view of the embodiment of the adjustable guide 10*a* of the elevator assembly 10 of FIG. 3. FIG. 4A reveals a plurality of guide inserts 30, each movably received within a channel 28 of in one of the guide insert retainer portions 11*a* and 11*b*. Each of the guide inserts 30 is shown in FIG. 4A are in a retracted position within a channel 28 in an insert retainer portion 11*a* or 11*b*. Each guide insert 30 shown in FIG. 4A comprises a generally sloped steering surface 30A disposed radially inwardly toward the bore 91 (see FIG. 3) of the elevator assembly 10. Each guide insert 30 is radially positionable within its channel 28 by rotation of a threaded shaft (not shown in FIG. 4A—see FIGS. 4B and 4C) that is rotatable to position the guide insert 30. Sockets 42 may be rotated to position the guide insert 30 within its channel 28 using, for example, a rotatable bit (not shown). For example, but not by way of limitation, a portable, battery-powered hand-held drill may be fitted with a bit adapted to be received within and rotatable with the socket 42. The bit may inserted into the socket 42, and powered rotation of the bit and the socket 42 using the drill may controllably position the guide insert 30 within the channel 28. Each of the other guide inserts 30 may then be positioned in a generally coinciding position within its respective channel 28 to position the sloped steering surfaces 30A of the guide inserts 30 to form a generally circular guide.

FIG. 4A illustrates the adjustable guide 10*a* with each guide insert 30 positioned within its channel 28 so that the sloped steering surface 30A of the guide insert 30 is generally flush with the portions of the interior wall of the bell guide 50 between the channels 28. The position of the guide inserts 30 and the sloped steering surfaces 30A of the guide inserts 30 illustrated in FIG. 4A may, for example, be used to make-up and run pipe strings 88 (see FIG. 2) having a diameter 88*a* in FIG. 2, also shown in FIGS. 5A and 6A.

The guide inserts 30 of the embodiment of the adjustable guide 10*a* shown in FIGS. 4A-4C may be positioned by rotation of the respective sockets 42 (see FIG. 3). Each of the sockets 42 may be formed on the end of an elongate threaded shaft (not shown in FIGS. 4A-4C—see FIGS. 5A-6C) that is coupled to a guide insert retainer portion 11*a* or 11*b* and rotatably coupled to a guide insert 30. Rotation of the sockets 42 and the threaded shafts may controllably position the guide inserts 30 to displace the sloped surfaces 30A from their position shown in FIG. 4A to a first deployed position, e.g., as shown in FIG. 4B and/or to a second deployed position e.g., as shown in FIG. 4C. In one embodiment, each of the threaded shafts may be rotated using a servo-motor that may be pneumatically, electrically and/or hydraulically operated. For example, but not by way of limitation, FIG. 4A shows a single servo-motor 48 that may be powered using a pressurized stream of air supplied to the servo-motor 48 through a fluid conduit 49. The servo-motor 48 may, in one embodiment, comprise a protruding rotatable bit for being received into the socket 42 at the end of the threaded shaft (not shown in FIGS. 4A-4C—see FIGS. 5A-6C) to impart rotation to the threaded shaft to controllably position the guide insert. It should be understood that the single servo-motor 48 and related fluid conduit 49 shown in FIG. 4A is an illustration of a device that could be provided at the socket 42 at the end of each threaded shaft to provide controllable positioning of each of the guide inserts. Only one servo-motor 48 is shown in FIGS. 4A-4C to reveal the components of the embodiment of the adjustable guide shown in these figures. It should be further understood that, where a pipe end is in contact with one or more sloped surfaces 30A of one or more guide inserts 30, rotation of the one or more sockets 42 and the related one or more threaded shafts may controllably position guide inserts 30 and the pipe end that contacts the sloped surfaces 30A of the guide inserts 30. By contrast, the guide inserts 30 may be pre-positioned to form a guide of a desired size to contact and guide a pipe end that is later introduced into the adjustable guide 10*a*.

It should be further understood that, where an actuator is used to position a guide insert 30 by, for example, but not by way of limitation, powered rotation of a threaded shaft on which the guide insert is threadably received, then a controller may be used to position the guide insert 30 at a predetermined or memorized position. For example, but not by way of limitation, a controller may be coupled to a sensor that senses the rotation of the threaded shaft, and that records the number of times the threaded shaft rotates during displacement of the guide insert. The sensor may be disposed within a common case with the actuator, or the sensor may be electronically, mechanically or optically coupled to the actuator or to the threaded shaft. The sensor may be used to disable the actuator upon rotation of the threaded shaft a predetermined number of times or, alternately, the sensor may be used to disable the actuator after the rotation of the actuator moves the guide insert or other member into a sensed proximity with the sensor. In this way, the guide insert may be pre-positioned, using the controller and the actuator, to receive and center a pipe end of a known diameter.

In another embodiment, an actuator may be coupled to one or more guide inserts to position the guide insert between the retracted position and one or more deployed positions, and vice-versa. An actuator can be fluid powered, electric powered, mechanically powered, etc. For example, but not by way of limitation, a fluidically powered rotary motor may be disposed within a plurality of cases 95, each of which is coupled to the adjustable guide 10*a* to rotate a socket 42 at the end of the threaded shaft (not shown in FIGS. 4A-4C—see FIGS. 5A-6C). E.g., the case 95 may be coupled to a source of pressurized air (not shown) through an air conduit 96. For example, a pneumatically powered rotary motor (not shown) may discharge depressurized air through vent holes 97 in the case 95. Only a single actuator is shown in FIGS. 4A-4C through 8A-8C in order to prevent crowding the drawings and obscuring other features. It will be understood by those skilled in the art that a plurality of actuators may be coupled to the adjustable guide 10*a* to deploy and/or retract a plurality of guide inserts, that the actuators may be linear or rotary, that the actuators may utilize separate or a common power fluid conduit, and that position indicators may also be added to facilitate desired positioning of the guide inserts.

FIG. 4B is a bottom perspective view of the adjustable guide 10*a* of FIG. 4A after deployment of each of the guide inserts 30 to a first deployed position. FIG. 4B shows each guide insert 30 protruding partially into the bore 91 (see FIG. 3) of the optional bell guide 50. The sloped steering surfaces 30A together define a smaller frustoconical guide generally centered about and aligned with the bore 91 (see FIG. 3) of the elevator assembly 10. The adjustable guide 10*a* configured as illustrated in FIG. 4B may be used, for example, to position a pipe string introduced into the adjustable guide 10*a* and having a diameter 88*b* (shown in FIG. 2) to enter the bore in the bottom of the tapered bowl 21 and then into the gripping zone of the elevator assembly 10.

FIG. 4C is a bottom perspective view of the adjustable guide 10*a* of FIG. 4B after further deployment of the guide inserts 30 to a second deployed position. FIG. 4C shows each guide insert 30 protruding substantially into the bore 91 (see FIG. 3) of the bell guide 50. The sloped steering surfaces 30A together define a still smaller frustoconical guide (as compared to that shown in FIG. 4B) generally centered about and aligned with the bore 91 of the elevator assembly 10. The adjustable guide 10*a* configured as illustrated in FIG. 4C may be used, for example, to position a pipe string introduced into the adjustable guide 10*a* and having a diameter 88*c* (shown in FIG. 2) to enter the bore in the bottom of the tapered bowl 21 and then into the gripping zone of the elevator assembly 10.

It should be understood that the guide inserts 30 of the embodiment of the adjustable guide 10*a* shown in FIGS. 4A-4C may be continuously positionable to form a guide having numerous configurations. In other embodiments, the guide inserts 30 may be discretely positionable to provide only an integer number of guides centered about the bore, each having a generally predetermined size.

Figure 5A:
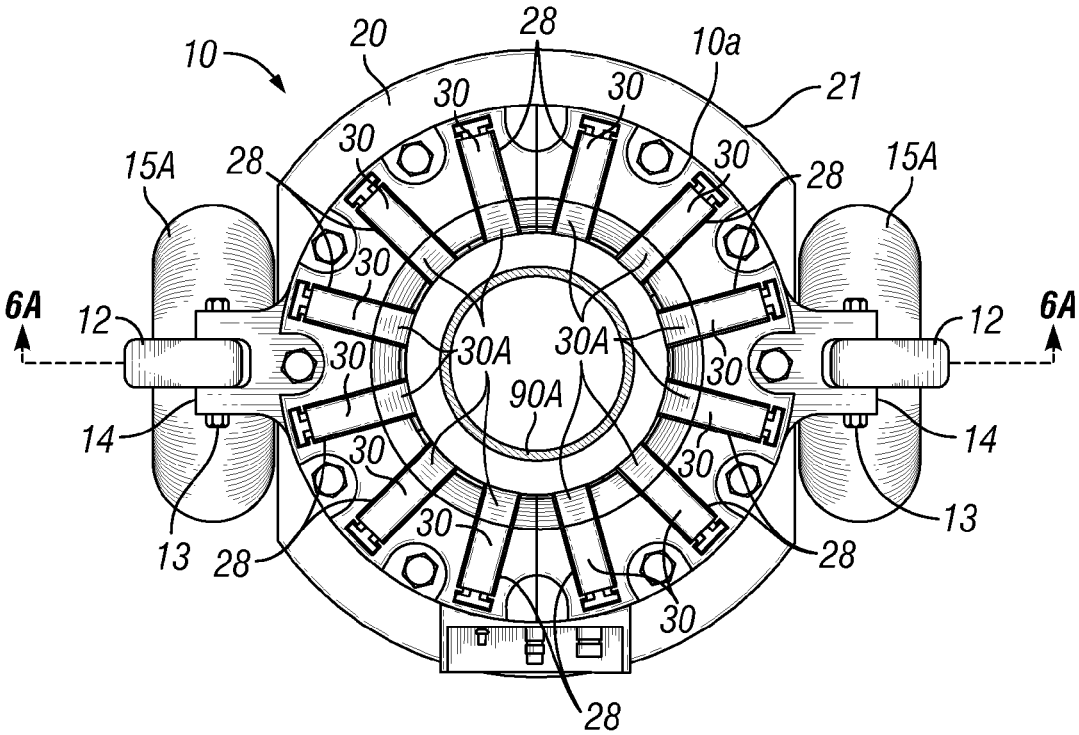
FIG. 5A is a bottom view of the elevator assembly and the adjustable guide of FIGS. 4A-4C illustrating the position of the proximal end of a pipe string of a first diameter that could be introduced into the adjustable guide to be positioned to enter the elevator assembly. The circle indicating the position of the proximal end of the pipe string corresponds to the position of the pipe string in FIG. 4A.

FIG. 5A is a bottom view of the elevator assembly 10 and the adjustable guide 10*a* of FIGS. 4A-4C illustrating a position of a proximal end 90*a* of a pipe string of a first diameter that could be introduced into the adjustable guide 10*a* to be positioned to enter the tapered bowl 21 of the elevator assembly 10. The circle may indicate a position of the proximal end of the pipe string that corresponds to the position of the pipe string in FIG. 6A as it is positioned by the adjustable guide

10*a* to enter the bore in the bottom of the tapered bowl 21 of the elevator assembly 10. The guide inserts 30 are each shown retracted within a channel 28 of the guide insert retainer 11 comprising the two cooperating guide insert retainer portions 11*a* and 11*b*.

Figure 5B:
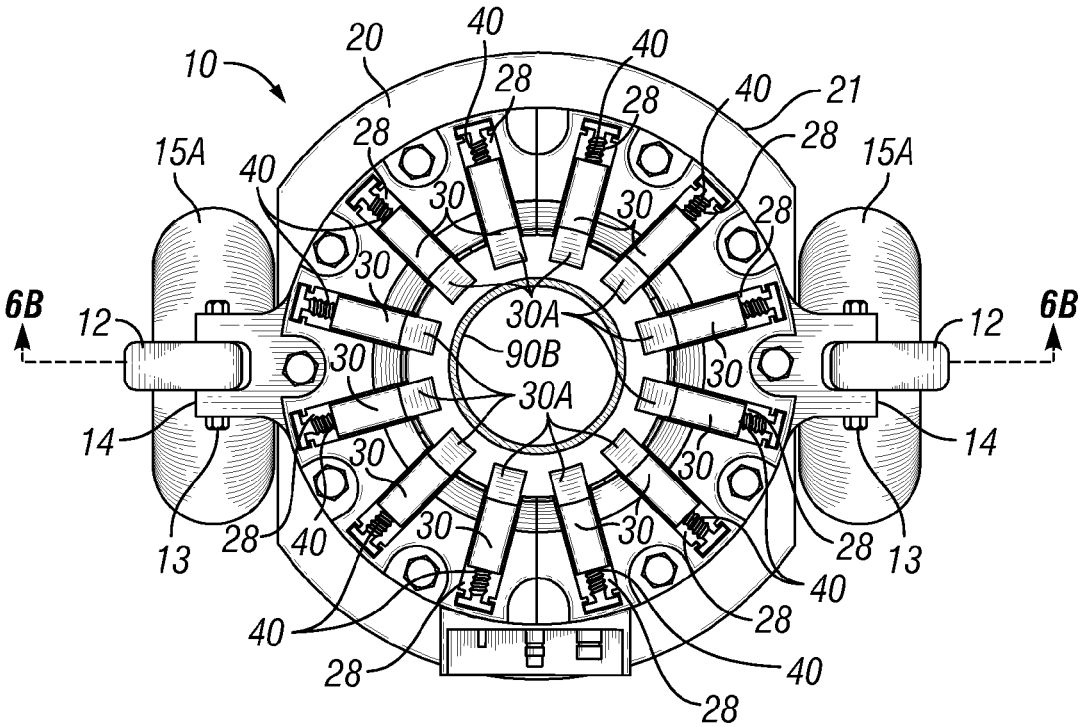
FIG. 5B is the bottom view of FIG. 5A illustrating the position of the proximal end of a pipe string of a second diameter, smaller than the first, that could be introduced into the adjustable guide to be positioned to enter the elevator assembly. The circle indicating the position of the proximal end of the pipe string corresponds to the position of the pipe string in FIG. 4B.

FIG. 5B is the bottom view of FIG. 5A illustrating the position of the proximal end 90*b* of a pipe string of a second diameter, smaller than the first, that could be introduced into the adjustable guide 10*a* to be positioned to enter the bore in the bottom of the tapered bowl 21 of the elevator assembly 10. The circle indicating the position of the proximal end 90*b* of the pipe string corresponds to the position of the pipe string in FIG. 6B as it is positioned by the adjustable guide 10*a* to enter the bore in the bottom of the tapered bowl 21 of the elevator assembly 10. The guide inserts 30 are each shown deployed to a first deployed position within a channel 28 of the guide insert retainer 11 comprising the two cooperating guide insert retainer portions 11*a* and 11*b*. As one of ordinary skill in the art can readily appreciate, additionally or alternatively to guide insert retainer 11, guide inserts 30 can be at least partially retained by rails, slides, rollers, or other retention device (s).

Figure 5C:
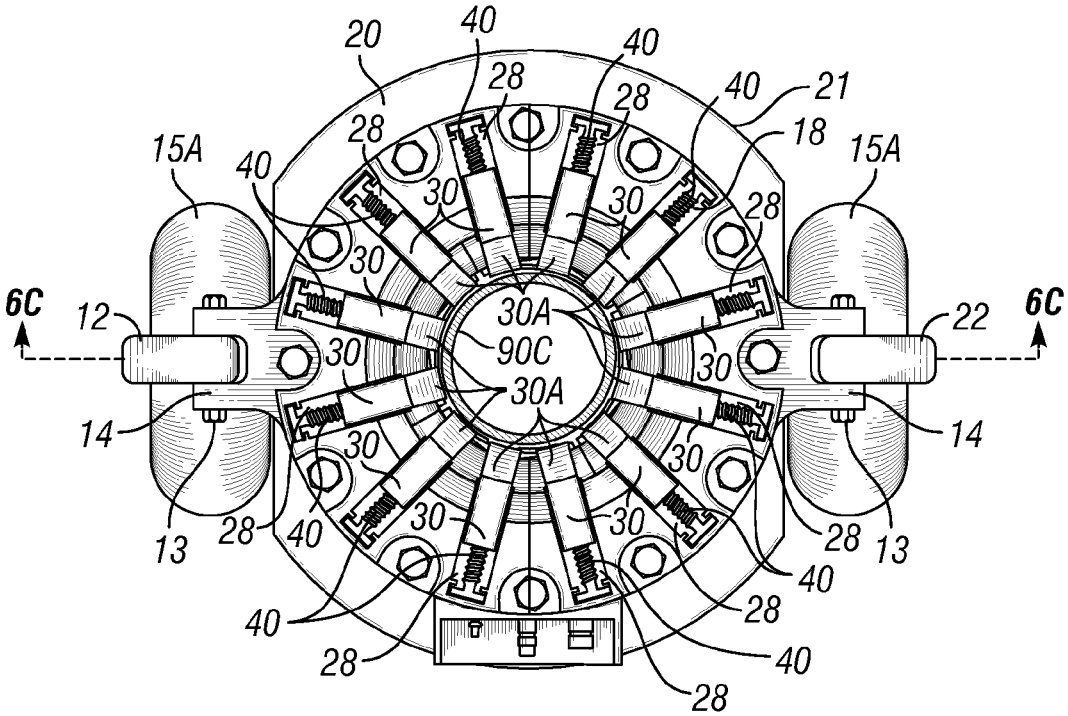
FIG. 5C is the bottom view of FIGS. 5A and 5B illustrating the position of the proximal end of a pipe string of a third diameter, smaller than the first and second, that could be introduced into the adjustable guide to be positioned to enter the elevator assembly. The circle indicating the position of the end of the pipe string corresponds to the position of the pipe string in FIG. 4C.

FIG. 5C is the bottom view of FIGS. 5A and 5B illustrating the position of the proximal end of a pipe string of a third diameter, smaller than the first and second, that could be introduced into the adjustable guide to be positioned to enter the elevator. The circle indicating the position of the proximal end 90*c* of the pipe string corresponds to the position of the pipe string in FIG. 6C as it is positioned by the adjustable guide 10*a* to enter the bore in the bottom of the tapered bowl 21 of the elevator assembly 10. The guide inserts 30 are each shown deployed to a first deployed position within a channel 28 of the guide insert retainer 11 comprising the two cooperating guide insert retainer portions 11*a* and 11*b*.

Figure 6A:
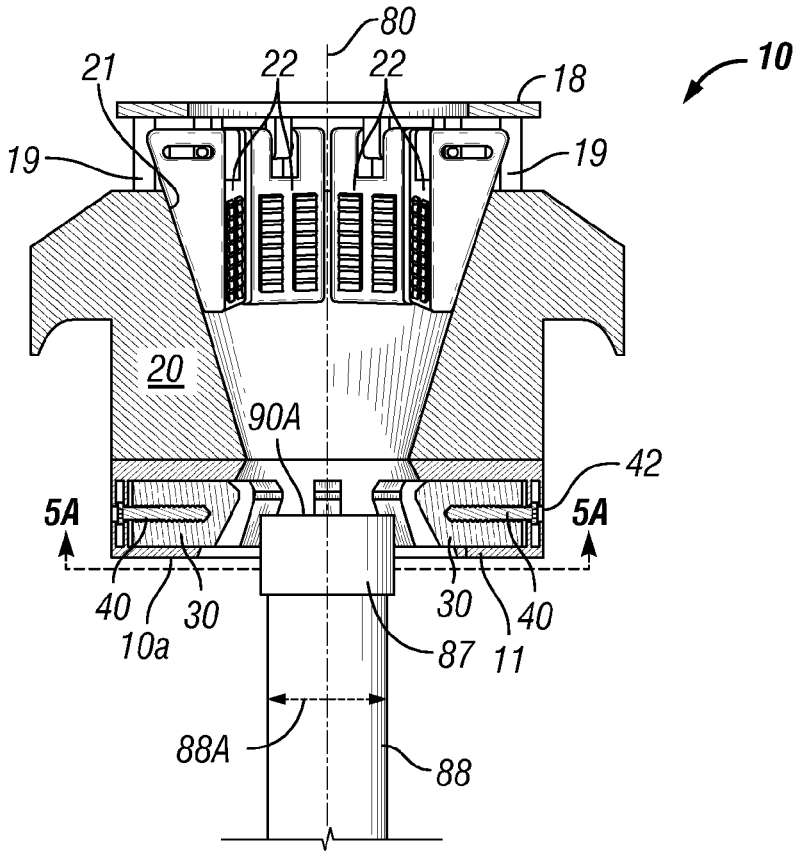
FIG. 6A is an elevation cross-section view of the tapered bowl and the adjustable guide of the elevator assembly of FIGS. 4A and 5A showing the position of the guide inserts, each retracted to a position within a channel in a guide insert retainer corresponding to the configuration shown in FIGS. 4A and 5A.

FIG. 6A is an elevation cross-section view of the tapered bowl 21 and the adjustable guide 10*a* of the elevator assembly 10 of FIGS. 4A and 5A showing the position of the guide inserts 30, each retracted to a position within a channel 28 in a guide insert retainer 11 corresponding to the configuration shown in FIGS. 4A and 5A. The adjustable guide 10*a* is shown in its fully retracted position to position a pipe string 88 having a diameter 88*a* to enter the elevator assembly 10.

Figure 6B:
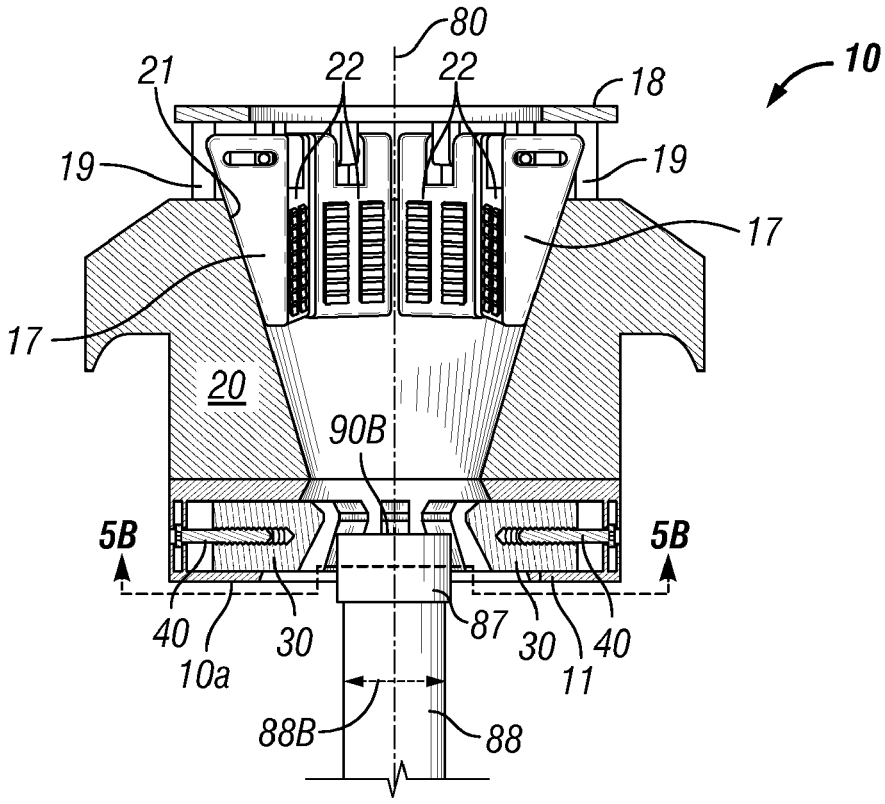
FIG. 6B is an elevation cross-section view of the tapered bowl and the adjustable guide of the elevator assembly of FIGS. 4B and 5B showing the position of the guide inserts, each deployed to a first deployed position within a channel in the guide insert retainer corresponding to the configuration shown in FIGS. 4B and 5B.

FIG. 6B is an elevation cross-section view of the tapered bowl 21 and the adjustable guide 10*a* of the elevator assembly 10 of FIGS. 4B and 5B showing the position of the guide inserts 30, each deployed to a first deployed position within a channel 28 in the guide insert retainer 11 corresponding to the configuration shown in FIGS. 4B and 5B. The adjustable guide 10*a* is shown in its substantially retracted position to position a pipe string 88 having a diameter 88*b* to enter the elevator assembly 10.

Figure 6C:
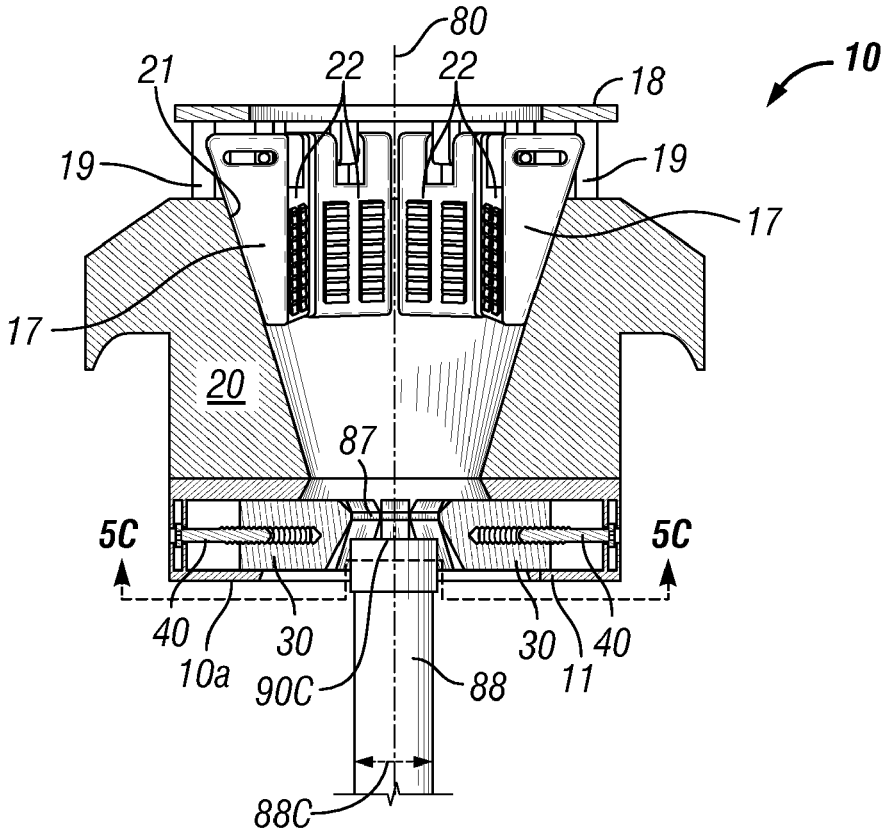
FIG. 6C is an elevation cross-section view of the tapered bowl and the adjustable guide of the elevator assembly of FIGS. 4C and 5C showing the position of the guide inserts, each deployed to a second deployed position within a channel of the guide insert retainer corresponding to the configuration shown in FIGS. 4C and 5C.

FIG. 6C is an elevation cross-section view of the tapered bowl 21 and the adjustable guide 10*a* of the elevator assembly 10 of FIGS. 4C and 5C showing the position of the guide inserts 30, each deployed to a second deployed position within a channel 28 of the guide insert retainer 11 corresponding to the configuration shown in FIGS. 4C and 5C. The adjustable guide 10*a* is shown in its fully retracted position to position a pipe string 88 having a diameter 88*c* to enter the elevator assembly 10.

Figure 1A:
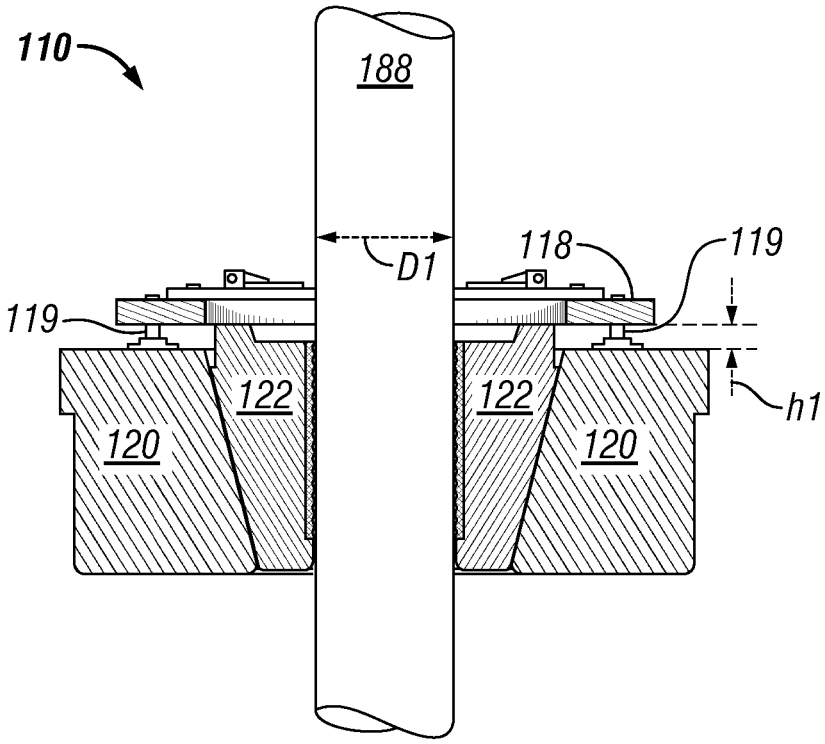
FIGS. 1A and 1B are elevation cross-section views of the tapered bowl of an elevator assembly or a spider having a smooth, non-stepped profile that may be used with the adjustable guide of the present invention.
Figure 1B:
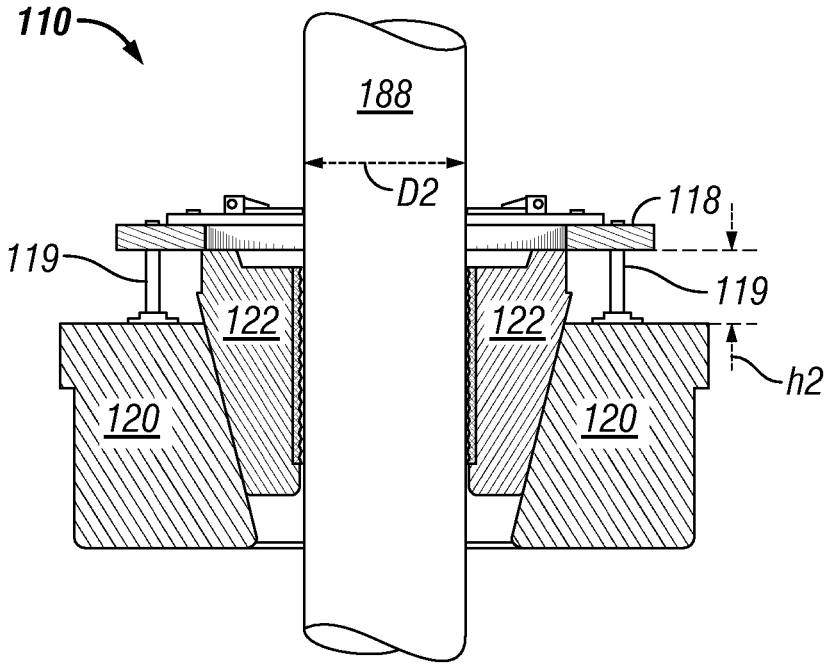
Figure 7:
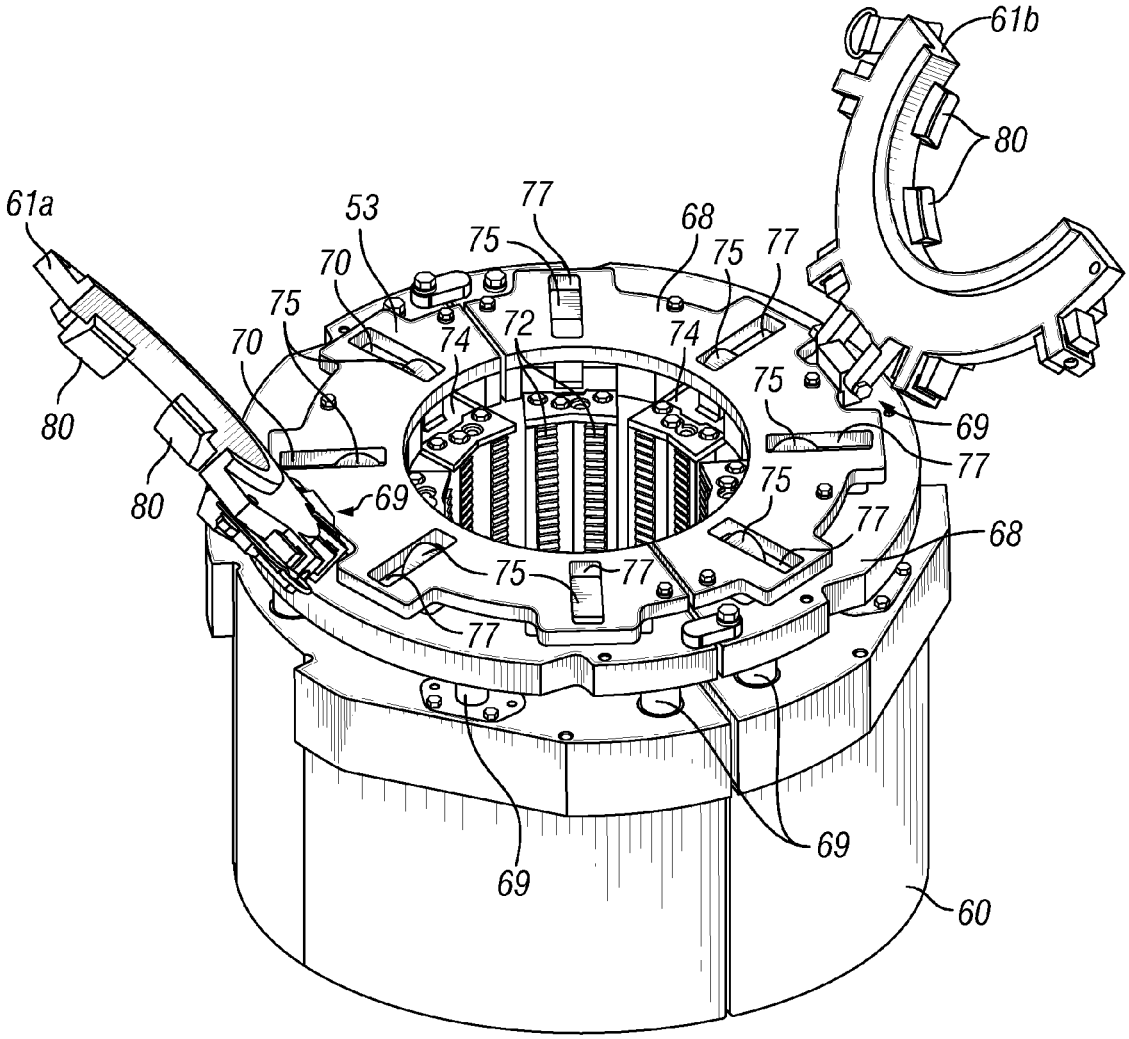
FIG. 7 is a perspective view of a spider assembly having another embodiment of the adjustable guide comprising two guide insert retainer portions hinged to pivot between the removed position shown in FIG. 7 and a deployed position, e.g., shown in FIGS. 8A, 8B and 8C.
Figure 8A:
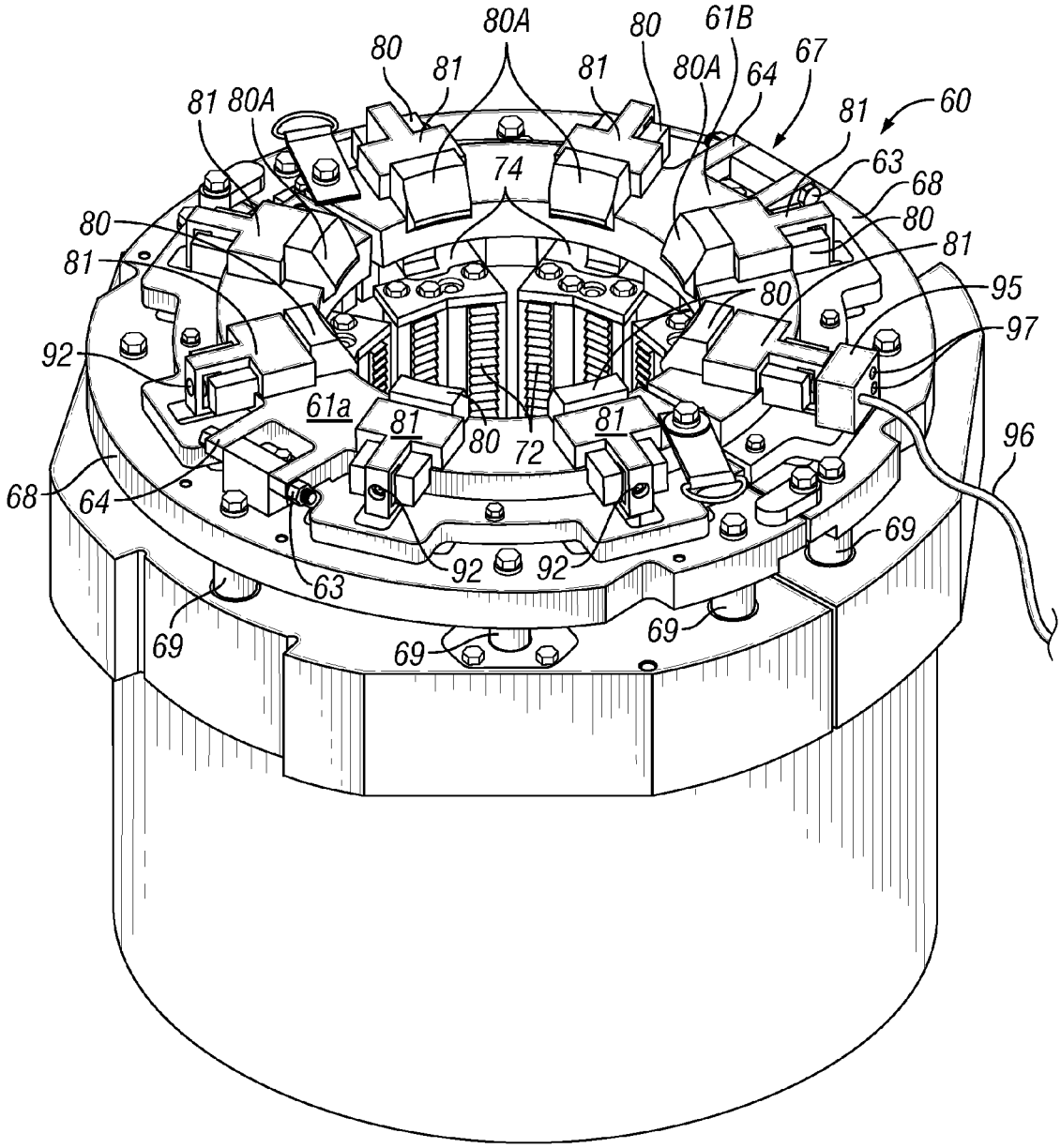
FIG. 8A is the perspective view of FIG. 7 after the guide insert retainer portions are pivoted to their deployed position to form a generally angularly distributed arrangement of guide inserts. The guide inserts are shown in their retracted position to receive and generally center a pipe connection having a diameter that corresponds to a pipe string of the first diameter shown in FIGS. 5A and 6A.
Figure 8B:
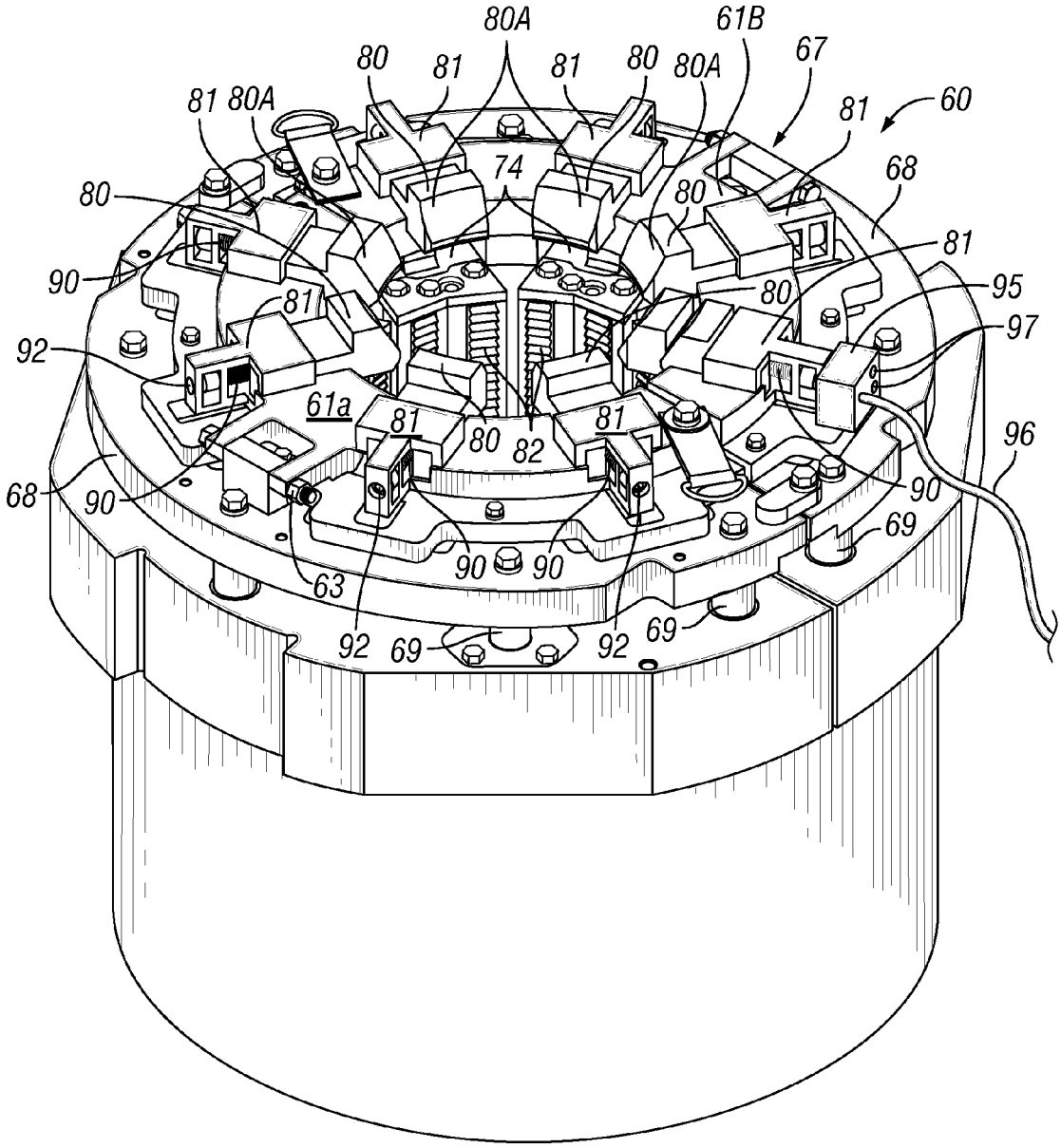
FIG. 8B is the perspective view of FIG. 8A after the guide inserts are each deployed to a first deployed position within a channel of the guide insert retainer to position a pipe connection having a diameter that corresponds to a pipe string of the second diameter shown in FIGS. 5B and 6B.
Figure 8C:
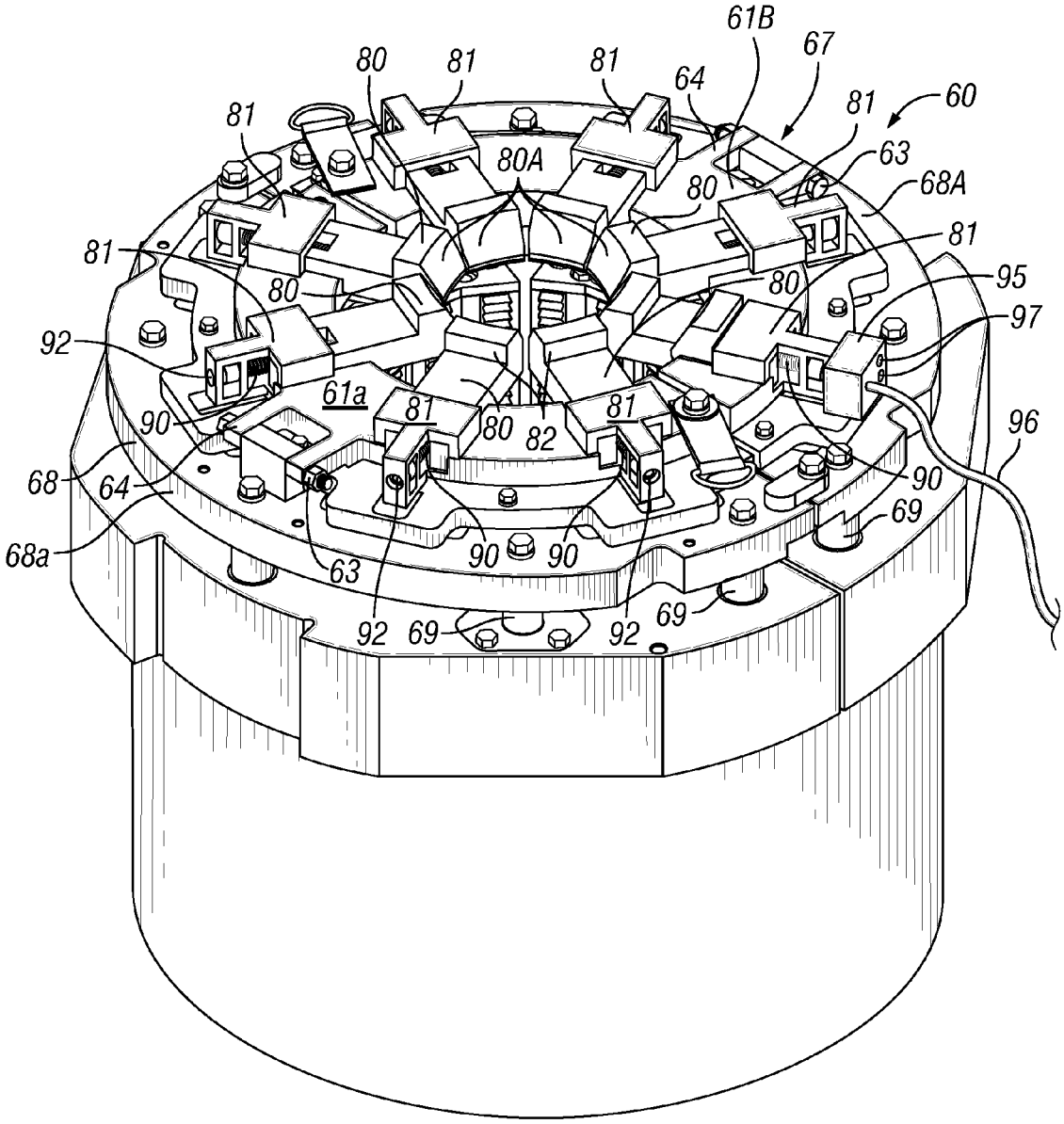
FIG. 8C is the perspective view of FIG. 8B after the guide inserts are each deployed further to a second deployed position within a channel to position a pipe connection having a diameter that corresponds to a pipe string of the third diameter shown in FIGS. 5B and 6B.

FIG. 7 is a perspective view of a spider assembly 60 having another embodiment of the adjustable guide 10*a* comprising two guide insert retainer portions 61*a* and 61*b* hinged to pivot between the removed position shown in FIG. 7 and a deployed position shown in FIGS. 8A, 8B and 8C. Each of the guide insert retainer portions 61*a* and 61*b* are hinged to a base 53 that is shown in FIG. 7 secured to the timing ring 68. The timing ring 68 is positionable, along with the base and the adjustable guide 60*a*, by extension and retraction of rods 69. It should be understood that the rods 69 may be positionable using an actuator. For example, an actuator that may be fluidically, electrically, or mechanically powered to lift and retact the slips 122 from a seated position, and/or to lower and engage the slips 122 with a pipe string 88, as shown in FIGS. 1A and 1B. Like the rods 19 that operate the timing ring 18 of the elevator assembly 10 (see FIG. 2), the rods 69 that operate the timing ring 68 of the spider 60 may also be pneumatically, electrically, hydraulically or mechanically powered between the extended position (not shown) and the retracted position shown in FIGS. 8A-8C.

The embodiment of the adjustable guide 60*a* shown in FIG. 7-8C comprises a plurality of guide inserts 80, each movably secured within a channel (not shown in FIG. 7—see FIGS. 8A-8C) within a guide insert retainer 61. The guide insert retainer 61 may comprise two or more cooperating guide insert retainer portions 61*a* and 61*b*. FIG. 7 shows the guide insert retainer portions 61*a* and 61*b* hinged to the base 53 and pivotable between a removed position (shown in FIG. 7) and a deployed position (shown in FIGS. 8A-8C). The removed position may be used to substantially open the spider assembly 60 to accommodate the installation of downhole instruments, centralizers and other devices that may not be small enough to fit through the bore of the adjustable guide 60*a* when the guide insert retainer portions 61*a* and 61*b* are in a deployed position.

FIG. 8A is the perspective view of FIG. 7 after the hinged guide insert retainer portions 61*a* and 61*b* are pivoted to their deployed position to form a generally angularly distributed arrangement of guide inserts 80 generally centered about the bore of the spider assembly 60. Hinged guide insert retainer portions 61*a* and/or 61*b* can be pivoted via an actuator (not shown). Each guide insert 80 depicted is movably received within a channel 81 within a guide insert retainer portion 61*a* or 61*b*. The depicted guide insert 80 is deployable between a retracted position, shown in FIG. 8A, and one or more deployed positions such as those illustrated in FIGS. 8B and 8C. The guide inserts 80 shown in FIGS. 8A-8C may be positionable by rotation of sockets 92 that drive and rotate threaded shafts (not shown in FIG. 8A—see FIGS. 8B and 8C) that are received into mating threaded apertures within each of the guide inserts 80. It should be understood that each threaded shaft may be rotatable using any of a variety of sockets, bits, connectors, heads or fittings including a polygonal recess, such as, for example, an allen-head socket, a groove, such as, for example, a Phillips, Torx or standard screw head, etc. There are numerous mechanical couplings for transmitting torque from a driver to a follower to rotate the follower, and many of these are known in the art and may be adapted for rotation of the threaded shaft.

FIG. 8B is the perspective view of FIG. 8A after the guide inserts 80 are deployed to a first deployed position by rotation of the sockets 92. Deployment of the guide inserts 80 in the manner illustrated in FIG. 8B positions the sloped surfaces 80A of the guide inserts 80 to define a funnel-like guide that is generally aligned with and centered about the bore of the spider assembly 60. In this configuration, the sloped surfaces 80A may engage the leading and downwardly disposed (leading) shoulder of a pipe connection corresponding to circle 90*b* in FIG. 2 (not shown in FIG. 8B) and impart a force tending to displace the pipe connection toward alignment with the center of the bore of the spider assembly 60. It should be noted that the deployment of the guide inserts 80 illustrated in FIG. 8B forms a guide to position a smaller pipe connection than will be engaged and centered by the configuration illustrated in FIG. 8A. It should be understood that a sloped surface 80A may comprise a surface suitable for sliding contact with a pipe end or a pipe connection, and does not necessarily comprise a straight or a planar surface to contact and position a portion of the pipe string. A sloped surface 80A may, in one embodiment, comprise a face that is curved circumferentially to the bore of the pipe gripping apparatus to which the adjustable guide is coupled. For example, but not by way of limitation, each guide insert may comprise a sloped surface that is radially disposed toward an extension of the bore of the pipe gripping apparatus to which the adjustable guide is coupled. The sloped surfaces of the set of movable guide inserts will generally surround the bore of the adjustable guide or, stated another way, the sloped surfaces will surround an extension of the bore of the pipe gripping apparatus, such as an elevator assembly or a spider, to which the adjustable guide is coupled. The radially inwardly disposed sloped surfaces may each comprise a curvature across its pipe contacting face and in a direction that is circumferential to a pipe string received through the bore of the pipe gripping assembly. In one embodiment, if the curvature of the sloped surface of each guide insert in the circumferential direction generally corresponds with the radius of the exterior of the pipe string, or to a pipe connection on the pipe string, to be engaged and positioned by the adjustable guide 10*a* so as to provide a plurality of points of contact between the sloped surface of each guide insert and the exterior surface of the pipe string or the pipe connection on the pipe string.

It should be further understood that the sloped surfaces 80A may also comprise a curvature, in addition to the curvature in the circumferential direction, if any, along the pipe contacting face of each guide insert and in a direction generally along the axis of the bore of the adjustable guide, or along the axis of the bore of pipe gripping apparatus to which the adjustable guide is coupled. In one embodiment, the curvature in the axial direction may be skewed off of parallel to the axis of the bore to "funnel" the pipe end or the pipe connection contacted by the adjustable guide toward the center of the bore. In one embodiment, the curvature of the face of the sloped surface may provide an axially concave shape to the guide insert along the sloped surface, and in another embodiment, the curvature of the face of the sloped surface may provide an axially convex shape to the guide insert along the sloped surface. It should be appreciated by those skilled in the art that the aggregation of the sloped surfaces of a set of movable guide inserts, each having a radially inwardly disposed sloped surface with a curvature that is convex in the axial direction, and the set generally surrounding the bore of the adjustable guide, may resemble an inverted vortex, and the aggregation of the sloped surfaces of a set of movable guide inserts, each having a radially inwardly disposed sloped surface with a curvature that is concave in the axial direction, may resemble an inverted bowl.

It should be understood that the movable guide inserts may be prepositioned to form a guide of a desired size and shape and to engage and steer a pipe end or a pipe connection toward the center of a bore of a pipe gripping apparatus, as described above. Alternately, where a pipe string or a pipe connection is in contact with one or more sloped surfaces 80A of one or more movable guide inserts 80, manual or powered rotation of the one or more sockets 92 and the related one or more threaded shafts may controllably position the contacting guide inserts 80 and the pipe string or pipe connection that contacts the sloped surfaces 80A of the guide inserts 80.

FIG. 8C is the perspective view of FIG. 8B after the guide inserts 80 are further deployed further to a second deployed position by rotation of the sockets 92. Deployment of the guide inserts 80 as illustrated in FIG. 8C positions the sloped surfaces 80A of the guide inserts 80 to define a second and still smaller guide that is generally aligned with the bore of the spider 60 and generally concentric with the guide formed by the sloped surfaces 80A shown in FIG. 8B. In this configuration, the sloped surfaces 80A may engage the leading and downwardly disposed shoulder of a smaller pipe connection of a diameter corresponding to circle 90*c* in FIG. 2 (not shown in FIG. 8C) and impart a net force tending to displace a pipe connection toward the center of the bore of the spider assembly 60. It should be noted that the deployment of the guide inserts 80 illustrated in FIG. 8C forms a guide to position a smaller pipe connection than will be engaged and centered by the configuration illustrated in FIGS. 8A and 8B.

It should be understood that the guide inserts may be secured to the guide insert retainer in a number of ways to ensure controllable positioning to form a guide. For example, but not by way of limitation, the guide inserts may each be pivotally coupled to the retainer so that the size of the steering guide formed by deployment of the guide inserts may be controlled by angularly pivoting the guide inserts into a deployed position rather than by displacement of the guide inserts while generally maintaining the same orientation of the guide inserts relative to the retainer.

It should be understood that an "elevator assembly," as used herein, means a vertically movable spider, a casing running tool (CRT) or any other pipe gripping assembly that can be manipulated to raise or lower a pipe string that is supported within the elevator assembly. It should be further understood that "pipe gripping apparatus," as used herein, means an apparatus that can support a pipe string, and specifically includes an elevator assembly and also includes a spider.

The terms "comprising," "including," and "having," as used in the claims and specification herein, shall be considered as indicating an open group that may include other elements not specified. The terms "a," "an," and the singular forms of words shall be taken to include the plural form of the same words, such that the terms mean that one or more of something is provided. The term "one" or "single" may be used to indicate that one and only one of something is intended. Similarly, other specific integer values, such as "two," may be used when a specific number of things is intended. The terms "preferably," "preferred," "prefer," "optionally," "may," and similar terms are used to indicate that an item, condition or step being referred to is an optional (not required) feature of the invention.

While the foregoing is directed to embodiments of the present invention, other and further embodiments of the invention may be devised without departing from the basic scope thereof, and the scope thereof is determined by the claims that follow.

We claim:

1. An adjustable guide to guide a portion of a pipe string towards a bore of a pipe gripping assembly comprising:

a plurality of guide inserts in a generally angularly distributed arrangement about the bore and radially movable between a first position and a second position;

wherein the plurality of guide inserts comprise a face;

wherein the plurality of guide inserts form a generally convergent surface to guide the portion of the pipe string towards the bore of the pipe gripping assembly;

wherein the pipe gripping apparatus is at least one of an elevator assembly and a spider; and wherein the first position of the plurality of guide inserts corresponds to a first outer diameter portion of a pipe string and the second position of the plurality of guide inserts corresponds to a second outer diameter portion of the pipe string.

2. The apparatus of claim 1 further comprising a plurality of actuators to move the plurality of guide inserts between the first position and the second position.

3. The apparatus of claim 1 wherein the plurality of guide inserts are slidably coupled to a guide insert retainer.

4. The apparatus of claim 1 wherein at least one of the plurality of guide inserts is movable independently of at least one other of the plurality of guide inserts.

5. The apparatus of claim 1 wherein the guide insert retainer comprises a plurality of cooperating guide insert retainer portions.

6. The apparatus of claim 5 wherein at least one of the plurality of guide insert retainer portions is movably coupled to the pipe gripping assembly, and the at least one guide insert retainer portion is pivotable between a deployed configuration, to position at least one of the plurality of guide inserts generally proximate the bore of the pipe gripping assembly, and at least one removed position, to position the at least one of the plurality of guide inserts generally away from the bore of the pipe gripping assembly.

7. The apparatus of claim 6 wherein the guide insert retainer portions are securable in the deployed configuration.

8. The apparatus of claim 7 wherein the guide insert retainer portions are actuatable between the at least one removed position and the deployed configuration.

9. The apparatus of claim 1 wherein the first position is a retracted position and the second position is a deployed position.

10. The apparatus of claim 2 wherein the plurality of actuators comprise at least one of a hydraulic actuator, a pneumatic actuator, a mechanical actuator and an electrical actuator.

11. The apparatus of claim 5 wherein at least one of the plurality of guide insert retainer portions is generally semicircular in shape.

12. The apparatus of claim 1 wherein the pipe gripping assembly comprises an elevator assembly.

13. The adjustable guide of claim 1 wherein the face is immovable on the plurality of guide inserts.

14. The adjustable guide of claim 1 wherein the face is curved about the bore.

15. The adjustable guide of claim 1 wherein the generally convergent surface generally forms a frustum.

16. The apparatus of claim 1 wherein the first position is a retracted position and the second position is a deployed position.

17. An adjustable guide to guide a portion of a pipe string towards a bore of a pipe gripping assembly comprising:

a plurality of guide inserts in a generally angularly distributed arrangement about a bore and radially movable between a first position and a second position;

wherein the plurality of guide inserts comprise a face; and wherein the plurality of guide inserts form a generally convergent surface to guide the portion of the pipe string towards the bore of the pipe gripping assembly; and at least one threaded shaft threadably engaging at least one of the plurality of guide inserts to move the at least one guide insert between a first position and a second position.

18. The apparatus of claim 17 further comprising an actuator coupled to at least one of the plurality of guide inserts to move at least one of the plurality of guide inserts between the first position and the second position.

19. The apparatus of claim 17 wherein the guide insert retainer comprises a plurality of cooperating guide insert retainer portions.

20. The apparatus of claim 19 wherein at least one of the guide insert retainer portions is movably coupled to the pipe gripping assembly, and the at least one guide insert retainer portion-is pivotable between a deployed configuration, to position at least one of the plurality of guide inserts generally proximate the bore of the pipe gripping assembly, and at least one removed position, to position the at least one of the plurality of guide inserts generally away from the bore.

21. The adjustable guide of claim 17 wherein the face is curved about the bore.

22. The adjustable guide of claim 17 wherein the generally convergent surface generally forms a frustum.

23. The apparatus of claim 17 further comprising a plurality of actuators to move the plurality of guide inserts between the first position and the second position.

24. The apparatus of claim 17 wherein the plurality of guide inserts are slidably coupled to a guide insert retainer.

25. The apparatus of claim 17 wherein at least one of the guide inserts is movable independently of at least one other of the guide inserts.

26. The apparatus of claim 17 wherein the guide insert retainer comprises two or more cooperating guide insert retainer portions.

27. The adjustable guide of claim 17 wherein the face is immovable on the plurality of guide inserts.

28. An adjustable guide to guide a portion of a pipe string towards a bore of a pipe gripping assembly comprising:

a plurality of guide inserts in a generally angularly distributed arrangement about a bore and radially movable between a first position and a second position;

wherein the plurality of guide inserts comprise a face;

wherein the plurality of guide inserts together form a generally convergent surface to guide the portion of the pipe string towards the bore of the pipe gripping assembly; and wherein at least one guide insert is pivotally movable between the first position and the second position.

29. The apparatus of claim 28 wherein the guide insert retainer comprises a plurality of cooperating guide insert retainer portions.

30. The apparatus of claim 29 wherein at least one of the guide insert retainer portions is movably coupled to the pipe gripping assembly, and the at least one guide insert retainer portion is pivotable between a deployed configuration, to position at least one of the plurality of guide inserts generally proximate the bore of the pipe gripping assembly, and at least one removed position, to position the at least one of the plurality of guide inserts generally away from the bore.

31. The adjustable guide of claim 28 wherein the face is curved about the bore.

32. The adjustable guide of claim 28 wherein the generally convergent surface generally forms a frustum.

33. The apparatus of claim 28 further comprising at least one actuator to move at least one of the plurality of guide inserts between the first position and the second position.

34. The apparatus of claim 28 wherein the plurality of guide inserts are translatably movable relative to a guide insert retainer.

35. The apparatus of claim 28 wherein at least one of the guide inserts is movable independently of at least one other of the guide inserts.

36. The apparatus of claim 28 wherein the first position is a retracted position and the second position is a deployed position.

37. The adjustable guide of claim 28 wherein the face is immovable on the plurality of guide inserts.

38. An adjustable guide to guide a portion of a pipe string comprising:

a guide insert retainer having a bore therethrough and connectable to at least one of an elevator assembly and a spider; and a plurality of guide inserts having a face and movably coupled to the guide insert retainer in a generally angularly distributed arrangement about the bore;

wherein the plurality of guide inserts are movable between a first position, in which the plurality of guide inserts generally define a first generally convergent surface to guide a portion of a pipe string, and a second position in which the plurality of guide inserts generally define a second generally convergent surface to guide the portion of the pipe string.

39. The adjustable guide of claim 38 further comprising:

an actuator to move at least one of the guide inserts between the first position and the second position.

40. The adjustable guide of claim 38 further comprising:

a plurality of actuators to move the plurality of guide inserts between the first position and the second position.

41. The adjustable guide of claim 40 wherein the plurality of actuators are selected from the group comprising a pneumatic cylinder, a hydraulic cylinder, a threaded shaft, and a rack and pinion gear.

42. The adjustable guide of claim 41 wherein the guide inserts are threadably coupled to a rotatable threaded shaft.

43. The adjustable guide of claim 38 wherein at least one of the first generally convergent surface generally defined by the face of the plurality of guide inserts in the first position and the smaller generally convergent surface generally defined by the guide inserts in the second position is generally shaped like a frustum.

44. The adjustable guide of claim 38 wherein the first position is a retracted position and the second position is a deployed position.

45. The adjustable guide of claim 38 wherein the plurality of guide inserts are pivotally coupled to the guide insert retainer.

46. The adjustable guide of claim 38 wherein the face is immovable on the plurality of guide inserts.

47. The adjustable guide of claim 38 wherein the face is curved about the bore.

48. The adjustable guide of claim 38 wherein the first generally convergent surface generally forms a frustum.

49. The adjustable guide of claim 38 wherein the face is immovable on the plurality of guide inserts.

50. An adjustable guide comprising:

a guide insert retainer having a bore therethrough;

a plurality of guide inserts having a face and movably coupled to the guide insert retainer in a generally angularly distributed arrangement about the bore; and a plurality of guide insert retainer portions movable between a deployed position, to position the guide inserts proximate the bore, and at least one removed position to position the guide inserts away from the bore;

wherein the guide inserts are movable relative to the guide insert retainer portions between a first position, to generally define a first generally convergent surface to guide a portion of a pipe string, and at least one second position to generally define a second generally convergent surface to guide the portion of the pipe string.

51. The adjustable guide of claim 50 wherein the face is curved about the bore.

52. The adjustable guide of claim 50 wherein the first generally convergent surface generally forms a frustum.

53. The apparatus of claim 50 wherein at least one of the guide insert retainer portions is movably coupled to the pipe gripping assembly, and the at least one guide insert retainer portions are pivotable between a deployed configuration, to position at least some of the guide inserts generally proximate the bore of the pipe gripping assembly, and at least one removed position, to position the at least one of the guide inserts generally away from the bore.

54. An adjustable guide comprising:

a plurality of angularly distributed guide inserts having a sloped face to guide an end of a pipe, and coupled to a guide insert retainer securable adjacent a pipe gripping apparatus;

wherein the plurality of guide inserts are inwardly movable from a first position into a bore of the guide insert retainer to a second position to vary a generally convergent surface defined by faces of the plurality of guide inserts;

wherein the pipe gripping apparatus comprises at least one of a spider and an elevator assembly; and wherein the first position of the plurality of guide inserts corresponds to a first outer pipe diameter portion of a pipe string to be guided towards a bore of the pipe gripping apparatus using the adjustable guide and the second position corresponds to a second outer pipe diameter portion of the pipe string to be guided towards the bore of the pipe gripping apparatus using the adjustable guide.

55. The apparatus of claim 54 wherein the guide insert retainer comprises two or more guide insert retainer portions cooperating to position the plurality of guide inserts.

56. The apparatus of claim 54 wherein a sloped face on at least one of the plurality of guide inserts is curved about the bore of the guide insert retainer.

57. The apparatus of claim 54 wherein the plurality of guide inserts is slidably coupled to the guide insert retainer.

58. The adjustable guide of claim 54 wherein the face is immovable on the plurality of guide inserts.

59. The adjustable guide of claim 54 wherein at least one of angularly distributed plurality of guide inserts is at least one of slidably, pivotally and threadably coupled to the guide insert retainer.

60. The adjustable guide of claim 54 wherein the generally convergent surface generally forms a frustum.

61. The adjustable guide of claim 54 wherein the elevator assembly comprises at least one of a string elevator and a casing running tool.

62. A method of guiding a portion of a pipe string toward a bore of a pipe gripping apparatus comprising the steps of:

coupling a plurality of guide inserts having a face to the pipe gripping apparatus in a generally angularly distributed arrangement about a bore through the pipe gripping apparatus to dispose the face of the plurality of guide inserts radially inwardly to form a generally convergent surface;

engaging a first outer diameter portion of the pipe string with the face of at least one of the plurality of guide inserts to guide the first outer diameter portion of the pipe string towards the bore of the pipe gripping apparatus;

moving the plurality of guide inserts from a first position to a second position; and engaging a second outer diameter portion of the pipe string with the face of at least one of the plurality of guide inserts to guide the second outer diameter portion of the pipe string towards the bore of the pipe gripping apparatus;

wherein the pipe gripping apparatus comprises at least one of an elevator assembly and a spider.

63. The method of claim 62 wherein the step of coupling the plurality of guide inserts having a face to the pipe gripping apparatus comprises:

slidably coupling the plurality of guide inserts to the pipe gripping apparatus.

64. The method of claim 62 wherein the portion of the pipe string is an end of a pipe string.

65. The method of claim 62 further comprising the step of:

moving the plurality of guide inserts from a first position, wherein the face of the plurality of guide inserts generally define a first generally convergent surface, to a second position wherein the face of the plurality of guide inserts generally define a second generally convergent surface that is smaller than the first generally convergent surface.

66. The adjustable guide of claim 62 wherein the face is curved about the bore.

67. The adjustable guide of claim 62 wherein the generally convergent surface generally forms a frustum.

68. The apparatus of claim 62 wherein the guide insert retainer portions are securable in the deployed configuration.

69. The adjustable guide of claim 62 wherein the face is immovable on the plurality of guide inserts.

70. A method of forming a pipe string on a rig comprising the steps of:

supporting a first pipe segment in a tapered bore of a spider using spider slips;

joining a second pipe segment to the first pipe segment to form the pipe string;

supporting an elevator assembly, having elevator slips in a tapered bore, above the spider;

disposing a plurality of guide inserts in a first position to form a first generally convergent surface adjacent at least one of the elevator assembly and the spider;

guiding a first outer diameter portion of the pipe string towards the bore of the at least one of the elevator assembly and the spider using the first generally convergent surface;

moving the plurality of guide inserts to a second position to form a second generally convergent surface; and guiding a second outer diameter portion of the pipe string towards the bore of the at least one of the elevator assembly and the spider using the second generally convergent surface.

71. The method of claim 70 wherein the first outer diameter portion of the pipe string is at least one of a pipe end and a pipe connection.

72. The method of claim 70, wherein the plurality of guide inserts are disposed adjacent the spider.

73. The method of claim 70, wherein the plurality of guide inserts are disposed adjacent the elevator assembly.

74. The adjustable guide of claim 70 wherein the first generally convergent surface generally forms a frustum.

75. The method of claim 70 wherein the elevator assembly comprises at least one of a string elevator and a casing running tool.

76. An adjustable guide to guide a portion of a pipe string towards a bore of a pipe gripping assembly comprising:

a plurality of guide inserts in a generally angularly distributed arrangement about a bore and radially movable between a first position and a second position;

wherein the plurality of guide inserts comprise a face and together form a generally convergent surface to guide the portion of the pipe string towards the bore of the pipe gripping assembly; and wherein the pipe gripping assembly comprises at least one of an elevator assembly and a spider.

77. The adjustable guide of claim 76 wherein the face is curved about the bore.

78. The adjustable guide of claim 76 wherein the generally convergent surface generally forms a frustum.

79. The apparatus of claim 76 wherein the guide insert retainer portions are actuatable between the at least one removed position and the deployed configuration.

80. The adjustable guide of claim 76 wherein the face is immovable on the plurality of guide inserts.

81. An adjustable guide to guide a portion of a pipe string towards a bore of a pipe gripping assembly comprising:

a plurality of guide inserts in a generally angularly distributed arrangement about a bore and radially movable between a first position and a second position;

wherein the plurality of guide inserts comprise a face and together form a generally convergent surface to guide the portion of the pipe towards a cylinder formed by a plurality of slips movably received within the pipe gripping assembly.

82. The adjustable guide of claim 81 wherein the face is curved about the bore.

83. The adjustable guide of claim 81 wherein the generally convergent surface generally forms a frustum.

84. The adjustable guide of claim 81 wherein the face is immovable on the plurality of guide inserts.

85. An adjustable guide to guide a portion of a pipe string towards a bore of a pipe gripping assembly comprising:

a plurality of guide inserts in a generally angularly distributed arrangement about a bore and radially movable between a first position and a second position wherein the plurality of guide inserts comprise a face and together form a generally convergent surface to guide the portion of the pipe string towards the bore of the pipe gripping assembly;

wherein the face of the plurality of guide inserts is generally flattened and sloped at an angle to an axis of the pipe gripping apparatus.

86. The adjustable guide of claim 85 wherein the face is immovable on the plurality of guide inserts.

87. The adjustable guide of claim 85 wherein the face is curved about the bore.

88. The adjustable guide of claim 85 wherein the generally convergent surface generally forms a frustum.

89. An adjustable guide to guide a portion of a pipe string towards a bore of a pipe gripping assembly comprising:

a plurality of guide inserts in a generally angularly distributed arrangement about a bore and radially movable between a first position and a second position wherein the plurality of guide inserts comprise a face and together form a generally convergent surface to guide the portion of the pipe string towards the bore of the pipe gripping assembly;

wherein the plurality of guide inserts are radially slidably coupled to the guide insert retainer.

90. The apparatus of claim 89 wherein the guide insert retainer comprises a plurality of cooperating guide insert retainer portions.

91. The apparatus of claim 90 wherein at least one of the plurality of guide insert retainer portions is movably coupled to the pipe gripping assembly, and the at least one guide insert retainer portion is pivotable between a deployed configuration, to position at least one of the plurality of guide inserts generally proximate the bore of the pipe gripping assembly, and at least one removed position, to position the at least one of the plurality of guide inserts generally away from the bore.

92. The adjustable guide of claim 89 wherein the face is immovable on the plurality of guide inserts.

93. The adjustable guide of claim 89 wherein the face is curved about the bore.

94. The adjustable guide of claim 89 wherein the generally convergent surface generally forms a frustum.

95. The apparatus of claim 89 further comprising at least one actuator to move at least one of the plurality of guide inserts between the first position and the second position.

96. The apparatus of claim 89 wherein the first position is a retracted position and the second position is a deployed position.

97. An adjustable guide to guide a portion of a pipe string towards a bore of a pipe gripping assembly comprising:

a plurality of guide inserts in a generally angularly distributed arrangement about a bore and radially movable between a first position and a second position wherein the guide inserts comprise a face and together form a generally convergent surface to guide the portion of the pipe string towards the bore of the pipe gripping assembly;

wherein the generally convergent surface is a frustum.

98. The adjustable guide of claim 97 wherein the generally convergent surface is a conical frustum.

99. The adjustable guide of claim 97 wherein the face is immovable on the plurality of guide inserts.

100. The adjustable guide of claim 97 wherein the face is curved about the bore.

* * * * *